US005978615A

United States Patent [19]

Tanaka et al.

[11] Patent Number: 5,978,615

[45] Date of Patent: Nov. 2, 1999

[54] TANDEM-TYPE IMAGE FORMING APPARATUS AND IMAGE FORMING CONDITION DETERMINATION METHOD USED IN THIS TANDEM-TYPE IMAGE FORMING APPARATUS

[75] Inventors: Masaki Tanaka, Toyohashi; Yukihiko Okuno, Toyokawa; Toshifumi Watanabe, Toyohashi, all of Japan

[73] Assignee: Minolta Co., Ltd., Osaka, Japan

[21] Appl. No.: 09/162,222

[22] Filed: Sep. 28, 1998

[30] Foreign Application Priority Data

Sep. 29, 1997 [JP] Japan ..... 9-263052

[51] Int. Cl.[6] ..... G03G 15/01; G03G 15/14

[52] U.S. Cl. ..... 399/49; 399/15; 399/51; 399/66

[58] Field of Search ..... 399/38, 46, 49, 399/51, 66, 299, 15; 358/296, 406, 504

[56] References Cited

U.S. PATENT DOCUMENTS

| | | | |
|---|---|---|---|
| 5,294,959 | 3/1994 | Nagao et al. | 399/46 X |
| 5,576,811 | 11/1996 | Kobayashi et al. | 399/15 X |
| 5,754,919 | 5/1998 | Sugimoto et al. | 399/49 |
| 5,774,762 | 6/1998 | Takemoto et al. | 399/51 X |

FOREIGN PATENT DOCUMENTS

| | | |
|---|---|---|
| 63-043189 | 2/1988 | Japan . |
| 63-279275 | 11/1988 | Japan . |
| 63-279276 | 11/1988 | Japan . |
| 1-179955 | 7/1989 | Japan . |

*Primary Examiner*—Robert Beatty
*Assistant Examiner*—Sophia S. Chen
*Attorney, Agent, or Firm*—Morrison & Foerster LLP

[57] ABSTRACT

Using an image forming apparatus, toner images are respectively formed on photosensitive drums of image forming units set along a transport belt, and the toner images are transferred onto the transport belt or a recording sheet transported on the transport belt to form a color image. The image forming apparatus is composed of a first density detecting sensor for detecting a density of a toner image formed on the recording sheet or the transport belt at the upstream side of each transfer position of at least one image forming unit which is located at the downstream side of a first image forming unit in a transport direction of the transport belt and which is selected as a subject of an image forming condition determination, a second density detecting sensor for detecting a density of the toner image formed on the recording sheet or the transport belt at the downstream side of the transfer position, and an image forming condition determining unit for comparing a detection value given by the first density detecting sensor with a detection value given by the second density detecting sensor and for determining an image forming condition in accordance with the comparison result for an image formation performed by the image forming unit selected as the subject.

24 Claims, 20 Drawing Sheets

| detection value by optical sensor (V) | amount of toner on transport belt (mg/cm$^2$) |
|---|---|
| 4.2 | 0.0 |
| 4.1 | 0.1 |
| 4.0 | 0.2 |
| 3.9 | 0.3 |
| ..... | ..... |
| 1.0 | 0.60 |
| 0.9 | 0.61 |
| 0.8 | 0.62 |
| 0.7 | 0.63 |
| .. | .. |
| 0.0 | 0.7 |

FIG. 5

VG/VB CORRECTION TABLE

| table No. | detected amount of toner (mg/cm$^2$) | VG(V) | VO(V) | VB(V) | $\gamma$ data |
|---|---|---|---|---|---|
| 0 | 0.625 | 500 | 480 | 280 | 0$\gamma$ |
| 1 | 0.510 | 540 | 520 | 320 | 1$\gamma$ |
| 2 | 0.445 | 570 | 545 | 345 | 2$\gamma$ |
| 3 | 0.400 | 600 | 570 | 370 | 3$\gamma$ |
| 4 | 0.380 | 630 | 590 | 390 | 4$\gamma$ |
| 5 | 0.340 | 670 | 630 | 420 | 5$\gamma$ |
| 6 | 0.305 | 710 | 660 | 440 | 6$\gamma$ |
| 7 | 0.275 | 750 | 700 | 480 | 7$\gamma$ |
| 8 | 0.250 | 800 | 750 | 540 | 8$\gamma$ |
| 9 | 0.210 | 900 | 820 | 620 | 9$\gamma$ |
| 10 | 0.180 | 1000 | 910 | 710 | 10$\gamma$ |

(a) cyan standard patch (b) magenta standard patch (c) yellow standard patch (d) black standard patch (e) standard patch on transport belt

FIG. 8

| table No. | total current of transfer output ($\mu$ A) |
|---|---|
| 0 | 100 |
| 1 | 110 |
| 2 | 120 |
| 3 | 130 |
| ⋮ | ⋮ |
| 25 | 350 |
| 26 | 370 |
| 27 | 390 |
| 28 | 410 |
| ⋮ | ⋮ |
| 31 | 440 |

FIG. 9

| output / time | $T_C$ | $T_M$ | $T_Y$ | $T_K$ |
|---|---|---|---|---|
| 1 | 7 | 9 | 11 | 13 |
| 2 | 9 | 11 | 13 | 15 |
| 3 | 11 | 13 | 15 | 17 |

FIG. 10

| | standard patch on transport belt | C | M | CM | Y | CY | MY | K | CK | MK | YK |
|---|---|---|---|---|---|---|---|---|---|---|---|
| | | detection value of each pattern(mg/cm$^2$) | | | | | | | | | |
| first detection (transfer output : Tc1,Tm1,Ty1,Tk1) | sensor 23 | $C_{1a}$ | | $C_{1a}$ | | $C_{1a}$ | | | $C_{1a}$ | | |
| | sensor 24 | $C_{1b}$ | $M_{1b}$ | $CM_{1b}$ | | $C_{1b}$ | $M_{1b}$ | | $C_{1b}$ | $M_{1b}$ | |
| | sensor 25 | $C_{1c}$ | $M_{1c}$ | $CM_{1c}$ | $Y_{1c}$ | $CY_{1c}$ | $MY_{1c}$ | | $C_{1c}$ | $M_{1c}$ | $Y_{1c}$ |
| | sensor 26 | $C_{1d}$ | $M_{1d}$ | $CM_{1d}$ | $Y_{1d}$ | $CY_{1d}$ | $MY_{1d}$ | $K_{1d}$ | $CK_{1d}$ | $MK_{1d}$ | $YK_{1d}$ |
| second detection (transfer output : Tc2,Tm2,Ty2,Tk2) | sensor 23 | $C_{2a}$ | | $C_{2a}$ | | $C_{2a}$ | | | $C_{2a}$ | | |
| | sensor 24 | $C_{2b}$ | $M_{2b}$ | $CM_{2b}$ | | $C_{2b}$ | $M_{2b}$ | | $C_{2b}$ | $M_{2b}$ | |
| | sensor 25 | $C_{2c}$ | $M_{2c}$ | $CM_{2c}$ | $Y_{2c}$ | $CY_{2c}$ | $MY_{2c}$ | | $C_{2c}$ | $M_{2c}$ | $Y_{2c}$ |
| | sensor 26 | $C_{2d}$ | $M_{2d}$ | $CM_{2d}$ | $Y_{2d}$ | $CY_{2d}$ | $MY_{2d}$ | $K_{2d}$ | $CK_{2d}$ | $MK_{2d}$ | $YK_{2d}$ |
| third detection (transfer output : Tc3,Tm3,Ty3,Tk3) | sensor 23 | $C_{3a}$ | | $C_{3a}$ | | $C_{3a}$ | | | $C_{3a}$ | | |
| | sensor 24 | $C_{3b}$ | $M_{3b}$ | $CM_{3b}$ | | $C_{3b}$ | $M_{3b}$ | | $C_{3b}$ | $M_{3b}$ | |
| | sensor 25 | $C_{3c}$ | $M_{3c}$ | $CM_{3c}$ | $Y_{3c}$ | $CY_{3c}$ | $MY_{3c}$ | | $C_3$ | $M_{3c}$ | $Y_{3c}$ |
| | sensor 26 | $C_{3d}$ | $M_{3d}$ | $CM_{3d}$ | $Y_{3d}$ | $CY_{3d}$ | $MY_{3d}$ | $K_{3d}$ | $CK_{3d}$ | $MK_{3d}$ | $YK_{3d}$ |

FIG. 18

γ CORRECTION TABLE

| table No. \ gradation level | 4 | 8 | 16 | 32 | 64 | 96 | 128 | 160 | 192 | 255 |
|---|---|---|---|---|---|---|---|---|---|---|
| 0γ | 18 | 21 | 24 | 28 | 38 | 47 | 59 | 76 | 98 | 255 |
| 1γ | 17 | 21 | 24 | 27 | 37 | 46 | 58 | 76 | 98 | 255 |
| 2γ | 16 | 20 | 23 | 27 | 37 | 46 | 57 | 75 | 97 | 255 |
| 3γ | 15 | 19 | 22 | 26 | 36 | 45 | 56 | 74 | 97 | 255 |
| 4γ | 14 | 19 | 22 | 26 | 36 | 45 | 55 | 74 | 96 | 255 |
| 5γ | 13 | 18 | 22 | 25 | 35 | 44 | 55 | 73 | 95 | 255 |
| 6γ | 12 | 18 | 21 | 25 | 34 | 44 | 54 | 73 | 94 | 255 |
| 7γ | 11 | 17 | 21 | 24 | 34 | 43 | 53 | 72 | 93 | 255 |
| 8γ | 10 | 17 | 20 | 24 | 33 | 43 | 52 | 71 | 93 | 255 |
| 9γ | 9 | 16 | 20 | 23 | 32 | 42 | 52 | 70 | 92 | 255 |
| 10γ | 8 | 15 | 19 | 23 | 32 | 41 | 51 | 69 | 91 | 255 |

FIG. 21A

| output / time | $T_C$ | $T_M$ | $T_Y$ | $T_K$ |
|---|---|---|---|---|
| 1 | 3 | 5 | 7 | 9 |
| 2 | 5 | 7 | 9 | 11 |
| 3 | 7 | 9 | 11 | 13 |

FIG. 21B

| output / time | $T_C$ | $T_M$ | $T_Y$ | $T_K$ |
|---|---|---|---|---|
| 1 | 13 | 15 | 17 | 19 |
| 2 | 15 | 17 | 19 | 21 |
| 3 | 17 | 19 | 21 | 23 |

TANDEM-TYPE IMAGE FORMING APPARATUS AND IMAGE FORMING CONDITION DETERMINATION METHOD USED IN THIS TANDEM-TYPE IMAGE FORMING APPARATUS

This application is based on application No. 9-263052 filed in Japan, the content of which is hereby incorporated by reference.

BACKGROUND OF THE INVENTION (1) Field of the Invention

The present invention relates to a so-called "tandem-type" image forming apparatus, and especially relates to an image forming condition adjusting technique used in such tandem-type image forming apparatuses.

(2) Related Art

Images formed by an image forming apparatus are adversely affected by wear and tear on the apparatus and change of surrounding conditions, so that image forming conditions, especially a transfer output, need to be adjusted for image transfer. To adjust the transfer output, not only the amount of toner attracted to a recording sheet or a transport belt (referred to as the "attracted toner" hereinafter), but also the amount of toner reattracted after image transfer (referred to as the "reattracted toner" hereinafter) needs to be considered. Here, the reattraction of toner means a state where toner having attracted to the recording sheet or the transport belt returns to an image holding component, namely, a photosensitive drum.

When only the attracted toner is considered, the transfer output is set so that an adequate amount of toner can be reliably attracted to the recording sheet. However, when the transfer output is set too high, the reattraction of toner occurs. More specifically, when the transfer output is set too high, a potential difference between the photosensitive drum and a transfer material, such as a transport belt, is considerably large. This causes electric discharge by Paschen's law when the recording sheet is separated from the photosensitive drum after image transfer. Due to this electric discharge, the same amount of positive charge and negative charge are produced in a space between the photosensitive drum and the part of the recording sheet to which no toner has been attracted. When image transfer is performed using a positive electric field, for example, the negative charge produced in that space is attracted to the transport belt via the recording sheet which has absorbed moisture in the air. Meanwhile, the positive charge produced in that space neutralizes the negatively charged toner on the recording sheet, or may positively charge the toner. The toner positively charged in this way leaves the recording sheet and is attracted to the negative electric field of the photosensitive drum, thereby causing the reattraction. This reattraction may cause blank spots on the reproduced image, so that it has to be prevented from occurring as much as possible.

To address this problem, a table is stored in a conventional image forming apparatus so that the transfer output is set to keep an appropriate balance between the attraction and reattraction of toner. The table stores transfer outputs having experimentally obtained corresponding to surrounding conditions, such as temperature and humidity inside the copier. Sensors detect the surrounding conditions, and then the transfer output is set using the table in accordance with the detected surrounding conditions.

Moreover, another technique has been suggested, by which an optical sensor detects toner reattracted to the photosensitive drum after image transfer and the transfer output is adjusted so that the reattracted toner is kept to the minimum.

However, by means of the method for adjusting the transfer output using the sensors which detect the surrounding conditions, it is difficult to determined an optimum transfer output since the actual amounts of the attracted toner and reattracted toner are not detected. More specifically, there are still problems caused by unevenness of the charge level of toner on the photosensitive drum due to toner characteristics caused in manufacturing and by instability of detection precision of a temperature sensor and a humidity sensor.

Meanwhile, by means of the method for detecting the reattracted toner on the photosensitive drum using the optical sensor, only the reattracted toner is detected, so that the transfer output based on the attracted toner cannot be set. In addition, if the attracted toner is to be detected, an optical sensor is separately required, thereby increasing cost.

Accordingly, an example where the transfer output is adjusted using detection results of the attracted and reattracted toner has been described. Note that the detection results can also be used for adjusting other image forming conditions, such as an exposure condition.

SUMMARY OF THE INVENTION

The first object of the present invention is to provide an image forming apparatus which determines the image forming condition without actually detecting the reattracted toner on the image holding component.

The second object of the present invention is to provide an image forming condition determination method, by which the image forming condition is determined without actually detecting the reattracted toner on the image holding component.

The first object can be achieved by an image forming apparatus made up of: a first image forming unit for forming a first electrostatic latent image on an image holding component and for transferring a toner image obtained by developing the first electrostatic latent image onto a transfer material which is moving; a second image forming unit, being located at a downstream side of the first image forming unit in a moving direction of the transfer material, for forming a second electrostatic latent image on an image holding component and for transferring a toner image obtained by developing the second electrostatic latent image onto the transfer material; a pattern image formation controlling unit for having the first image forming unit form a pattern image on the transfer material, with the pattern image being used for determining an image forming condition; a density detecting unit for detecting a density of the pattern image formed on the transfer material as a first density detection value before the pattern image passes by the second image forming unit and for detecting a density of the pattern image formed on the transfer material as a second density detection value after the pattern image passes by the second image forming unit; and an image forming condition setting unit for comparing the first density detection value with the second density detection value, for determining an image forming condition in accordance with a comparison result, and for setting the image forming condition for an image formation performed by the second image forming unit.

With this construction, the density of the pattern image formed by the first image forming unit is detected before and after the pattern image passes by the second image forming unit located at the downstream side of the first image forming unit, and, in accordance with the comparison result obtained by comparing two detection values, the image forming condition is set for image formation performed by the second image forming unit. As a result, the image forming condition can be set without actually detecting the reattracted toner on the image holding component of the second image forming unit. The second object can be achieved by a method for determining an image forming condition using an image forming apparatus, the method including: a first step for transferring a pattern image formed by a first image forming unit onto a transfer material which is moving, with the pattern image being used for determining an image forming condition; a second step for detecting a density of the pattern image formed on the transfer material as a first density detection value before the pattern image passes by the second image forming unit which is located at a downstream side of the first image forming unit in a moving direction of the transfer material; a third step for detecting a density of the pattern image formed on the transfer material as a second density detection value after the pattern image passes by the second image forming unit; and a fourth step for comparing the first density detection value with the second density detection value and for determining an image forming condition in accordance with a comparison result for a next image formation performed by the second image forming unit.

By means of this method, the density of the pattern image formed by the first image forming unit and transferred onto the transfer material is detected before and after the pattern image passes by the second image forming unit located at downstream side of the first image forming unit, and, in accordance with the comparison result obtained by comparing two detection values, an image forming condition is set for a next image formation performed by the second image forming unit. As a result, the image forming condition can be determined without actually detecting the reattracted toner on the image holding component of the second image forming unit.

BRIEF DESCRIPTION OF THE DRAWINGS

These and other objects, advantages and features of the invention will become apparent from the following description thereof taken in conjunction with the accompanying drawings which illustrate a specific embodiment of the invention. In the drawing:

FIG. 5 is an example of a VG/VB correction table;

FIG. 8 is a table example for setting a transfer output of a transfer brush;

FIG. 9 is a table example showing the transfer output corresponding to each brush for each time to form the standard patch;

FIG. 10 shows detection values of the standard patches detected by the optical sensors;

FIG. 18 is an example of a $\gamma$ correction table;

FIG. 21A is a table example showing the transfer output corresponding to each brush for each time to form the standard patch when the humidity is high; and FIG. 21B is a table example showing the transfer output corresponding to each brush for each time to form the standard patch when the humidity is low.

DESCRIPTION OF PREFERRED EMBODIMENTS

The following is a description of an embodiment of the image forming apparatus of the present invention, with reference to the drawings. In the embodiment, a tandem-type digital color copying machine (referred to as the "copier" hereinafter) is used as an example of such an image forming apparatus.

(1) Construction of Copier

Figure 1:
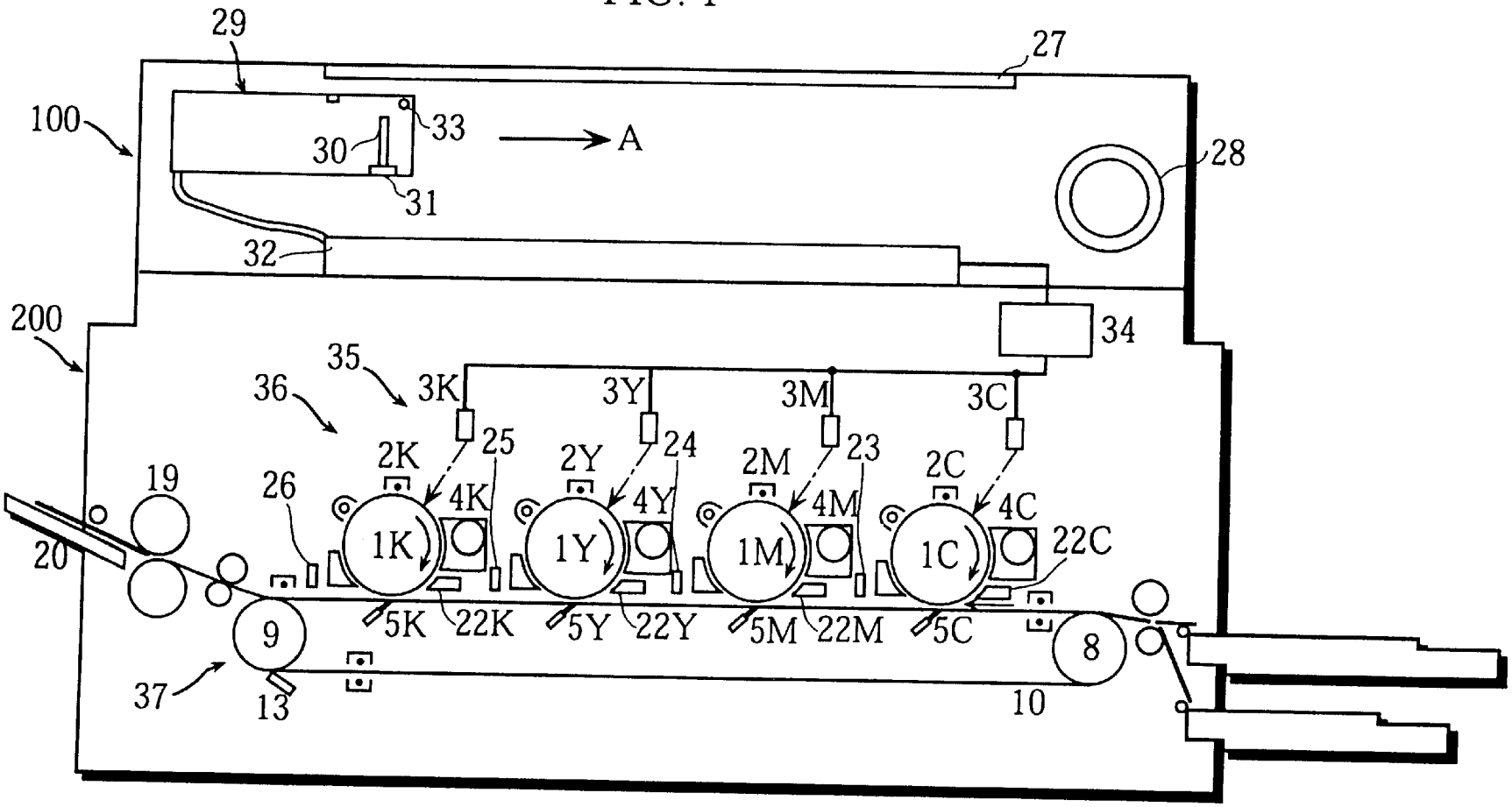
FIG. 1 shows a schematic construction of a digital color copying machine of the present invention.

FIG. 1 shows a schematic construction of copier of the present invention. This tandem-type copier has image forming units set along a transport belt. Images formed by the image forming units are sequentially transferred onto a recording sheet at the correct position, so that a color image can be obtained. Although the copier is described as an example of the present invention in the embodiment, the present invention is not limited to this. For example, a tandem-type image forming apparatus, such as a laser printer and a facsimile, can be used.

As shown in FIG. 1, the copier is roughly composed of an image reading unit 100 for reading a document image and a printing unit 200 for reproducing the document image read by the image reading unit 100.

The image reading unit 100 is provided with a scanner 29 for scanning a document placed on a platen glass 27 and for reading the document image as multivalued electric signals and a signal processing unit 32 for performing processes, such as a gradation data correction, on the obtained electric signals. The scanner 29 is driven by a motor 28 to scan the document and moves laterally as shown by the arrow A in FIG. 1. Light from an exposure lamp 33 of the scanner 22 is reflected off the document placed on the platen glass 27, and is converged by a rod lens array 30. The converged light is converted into multivalued electric signals for three colors, red, green, and blue by a contact-type CCD color image sensor 31. The signal processing unit 32 converts each multivalued electric signal into 8-bit gradation data of yellow, magenta, cyan, or black and also performs the color correction processing, etc.

The printing unit 200 is composed of a printing processing unit 34, a laser optical system 35, an image forming system 36, and a transporting system 37. With this construction, the printing processing unit 34 generates a laser diode driving signal for each gradation data in accordance with the signal outputted from the signal processing unit 32, and then has laser diodes of corresponding printer heads 3C to 3K of the laser optical system 35 emit laser beams in accordance with corresponding driving signals. The Laser beam exposes a corresponding photosensitive drum 1C to 1K.

The photosensitive drums 1C to 1K are uniformly charged by chargers 2C to 2K. By means of the exposure, electrostatic latent images are respectively formed on the surfaces of the photosensitive drums 1C to 1K. Developing units 4C to 4K respectively develop the electrostatic latent images formed on the corresponding photosensitive drums 1C to 1K using toner of corresponding colors cyan, magenta, yellow, and black. The developed toner images are sequentially transferred onto the recording sheet transported by a transport belt 10 by means of actions of the positive electric fields applied by transfer brushes 5C to 5K. The recording sheet is separated from the transport belt 10 after image transfer, and a fixing unit 19 then fixes toner particles forming the image on the recording sheet. After this, the recording sheet is discharged onto a discharge tray 20. Note that the transport belt 10 runs over a driving roller 9 and a slave roller 8. A belt cleaner 13 is set underneath the driving roller 9 as shown in FIG. 1 for removing toner particles forming a standard patch described later and paper dust from the surface of the transport belt 10.

AIDC (Automatic Image Density Control) sensors 22C to 22K are respectively provided for the photosensitive drums 1C to 1K for detecting the corresponding amount of toner before image transfer. Each of the AIDC sensors 22C to 22K detects the amount of toner forming a standard toner image (also referred to as the "AIDC pattern") which is formed on a predetermined area of the corresponding photosensitive drum 1C to 1K. In accordance with the detection result, a grid voltage VG and a developing bias voltage VB are set. Details of this setting operation are described later in this specification.

Optical sensors 23 to 26 for each detecting a density of the transferred image are respectively set at downstream sides of the photosensitive drums 1C to 1K in the transport direction of the recording sheet, with the photosensitive drums 1C to 1K being set along the transport belt 10. Of these sensors, the optical sensors 23 to 25 respectively detect the densities of the image having transferred at transfer positions of the photosensitive drums 1C to 1Y, and also respectively detect the densities of the image before the image reaches the transfer positions of the photosensitive drums 1M to 1K. More specifically, as one example, the optical sensors 23 and 24 respectively detect the densities of the image at the upstream side and the downstream side (referred to as "before and after" hereinafter) of the transfer position of the photosensitive drum 1M. In the same way, the optical sensors 24 and 25 respectively detect the densities of the image before and after the transfer position of the photosensitive drum 1Y, and the optical sensors 25 and 26 respectively detect the densities of the image before and after the transfer position of the photosensitive drum 1K.

Figures 2A, 2B:
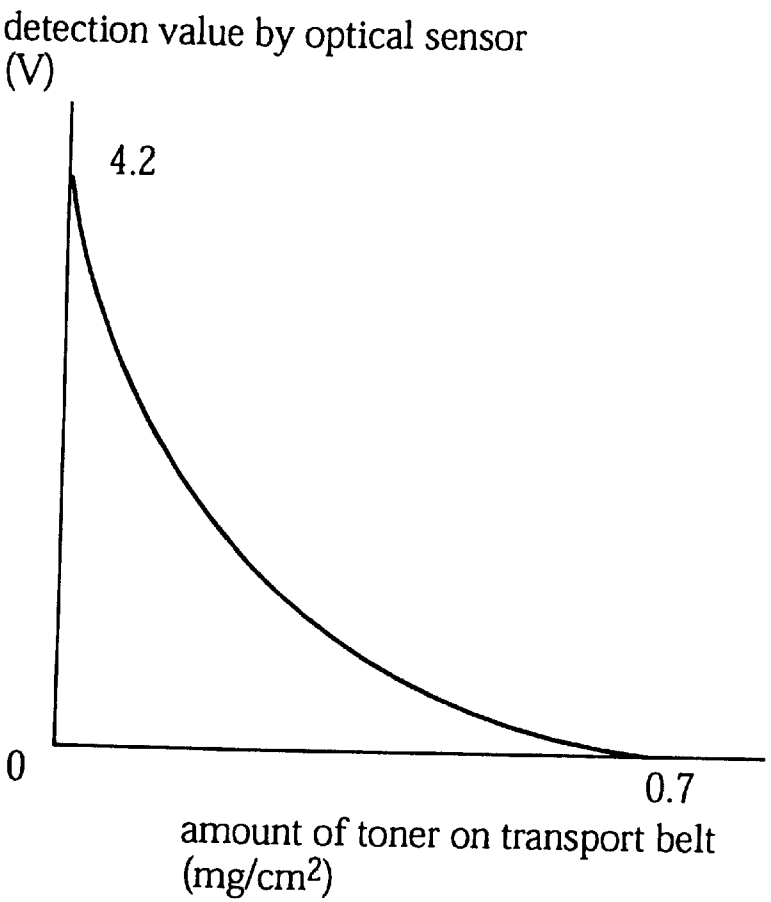
FIG. 2A shows a reading characteristic of an optical sensor.
FIG. 2B is a table showing the reading characteristic of the optical sensor.

The optical sensors 23 to 26 respectively detect densities of a standard patch (described later) formed on the transport belt 10. The detection values are used for various adjustment controls, such as a resist control, a transfer output control, and a γ correction control. Of these controls, the transfer output control and the γ correction control are explained later. FIGS. 2A and B show the reading characteristics of the optical sensors 23 to 26. As shown in these figures, one detection value given by one of the optical sensors 23 to 26 corresponds to one amount of toner on the transport belt 10. Therefore, the toner density can be obtained from the detection value.

(2) Controlling System

Figure 3:
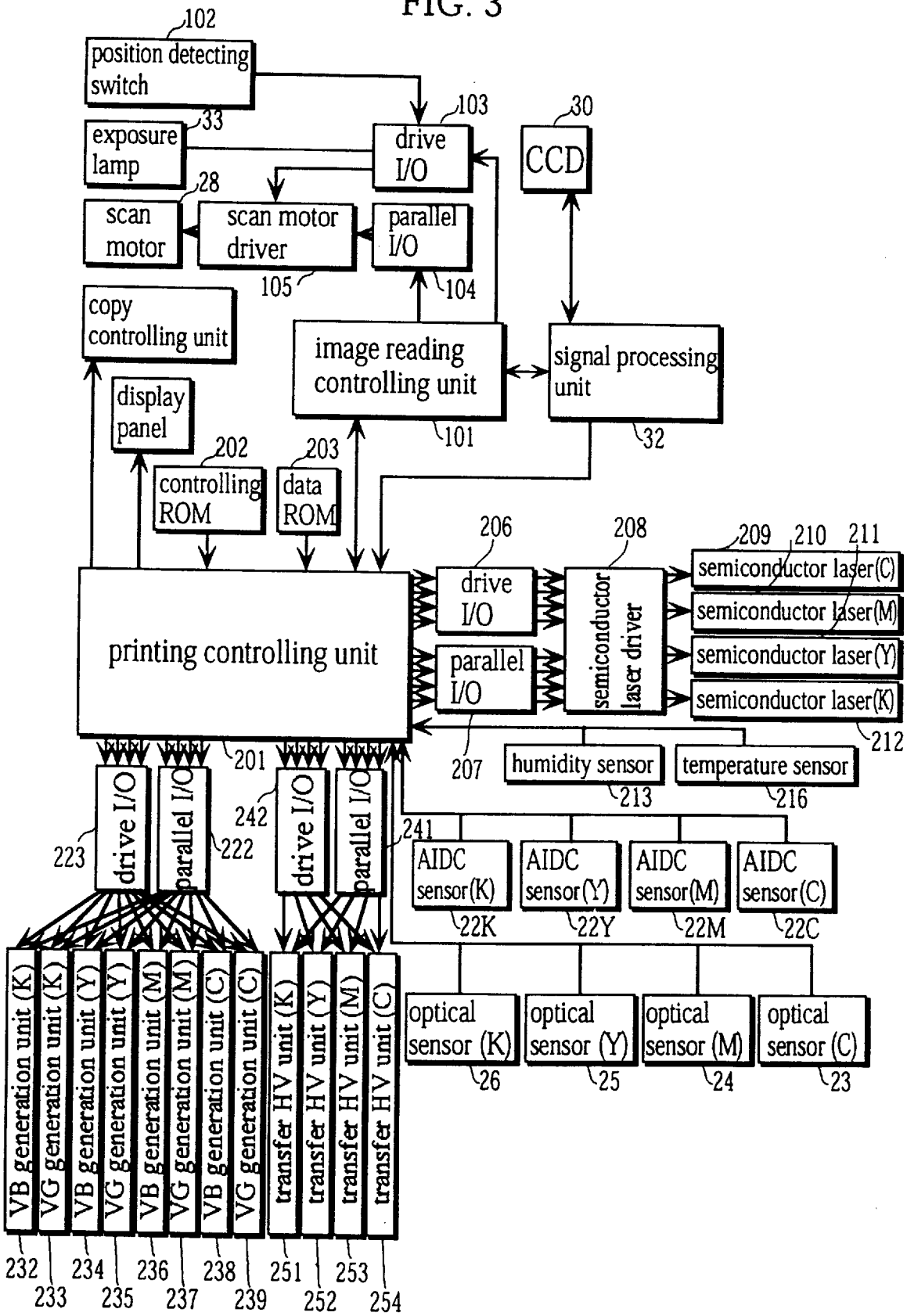
FIG. 3 is a block diagram showing a hardware construction of a controlling system provided in the digital color copying machine of the present invention.

The following is a description of the controlling system of the copier. FIG. 3 is a block diagram showing the construction of the controlling system. Central components comprising the controlling system are an image reading controlling unit 101 for controlling the image reading unit 100, a signal processing unit 32, and a printing controlling unit 201 for controlling the printing unit 200.

The image reading controlling unit 101 controls an exposure lamp 33 and a scan motor driver 105 which drives a scan motor 28, via a drive I/O 103 and a parallel I/O 104 in accordance with a position signal outputted from a position detecting switch 102. Here, the position signal from the position detecting switch 102 indicates a position of a document on a platen glass 27. In accordance with this control operation, the signal processing unit 32 performs processing, such as gradation data conversion and shading correction, on image signals read by the CCD color image sensor 31. The printing controlling unit 201 controls a semiconductor laser driver 208 via a drive I/O 206 and a parallel I/O 207 in accordance with the image signals processed by the signal processing unit 32, according to programs stored in the controlling ROM 202 and using various data stored in a ROM 203. Then, the printing controlling unit 201 drives semiconductor lasers 209 to 212 to expose the photosensitive drums 1C to 1K and also controls the image forming units. As a part of controlling the image forming units, the transfer brushes 5C to 5K can be controlled by transfer HV units 251 to 254 via a drive I/O 242 and a parallel I/O 241. The transfer output control performed by the transfer HV units 251 to 254 is explained later in this specification.

Furthermore, the printing controlling unit 201 receives detection signals from the AIDC sensors 22C to 22K which respectively detect the amounts of toner on the photosensitive drums 1C to 1K, the optical sensors 23 to 26 which respectively detect the amounts of toner on the transport belt 10, a temperature sensor 216, and a humidity sensor 213. In accordance with these detection values, various controls are performed, such as an automatic density control, a transfer output control, an exposure control, and a resist control.

The automatic density control is explained. Via a parallel I/O 222 and a drive I/O 223, the grid voltages VGs of the chargers 2C to 2K are generated by grid voltage generating units 239, 237, 235, and 233, and the developing bias voltages VBs of the developing units 4C to 4K are generated by developing bias units 238, 236, 234, and 232 in accordance with the detection values given by the AIDC sensors 22C to 22K, using a table which is stored beforehand. The image density is controlled using the generated grid voltage VG and developing bias voltage VB for each color.

Figure 4:
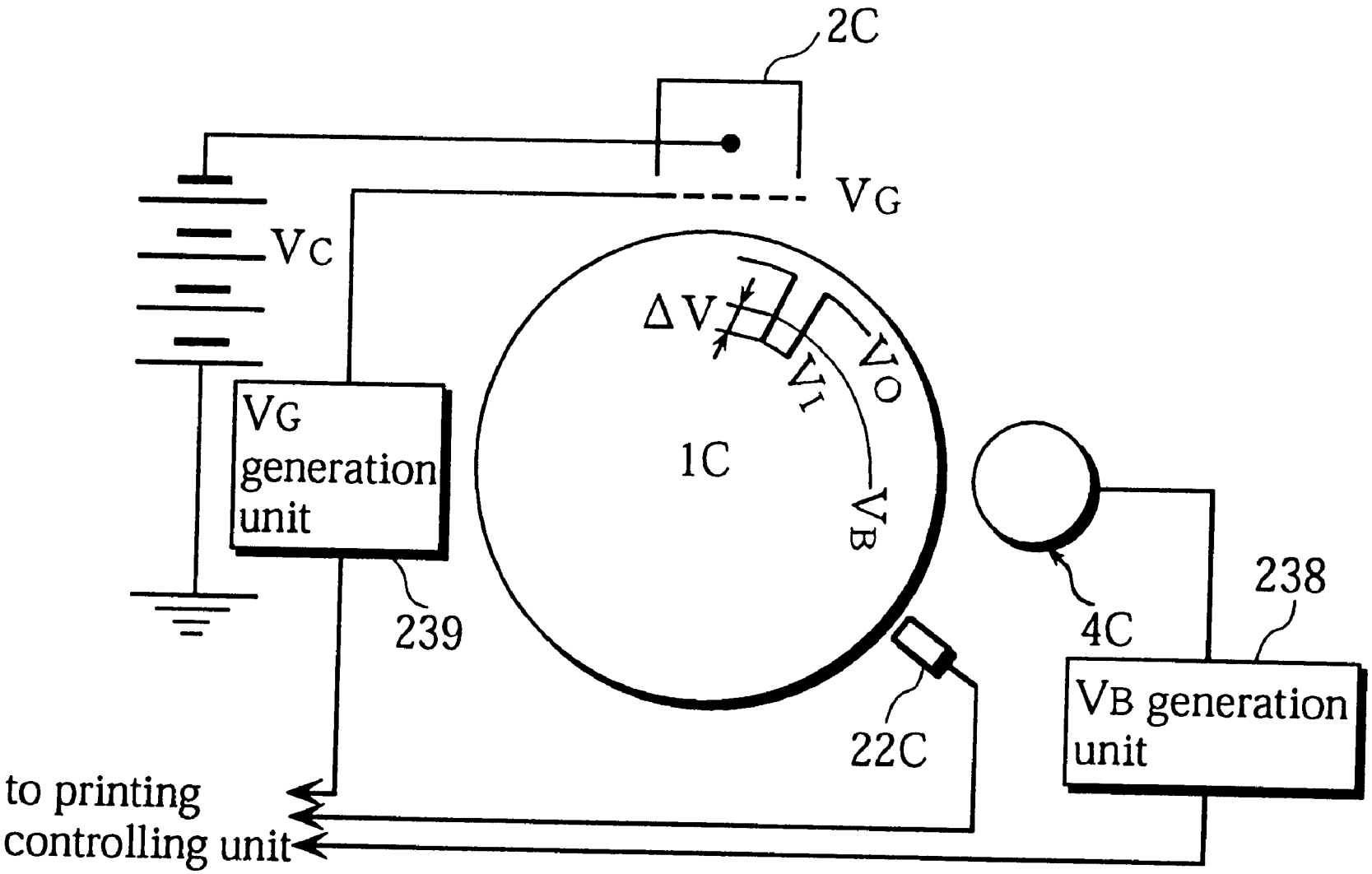
FIG. 4 is a representation showing an arrangement construction of an image forming unit.

As one example, the control of the grid voltage VG and the bias voltage VB for the image forming unit of cyan is explained. FIG. 4 is a representation showing the arrangement of the photosensitive drum 1C, the charger 2C, and the developing unit 4C of the image forming unit for cyan. As shown in FIG. 4, the charger 2C is set facing the photosensitive drum 1C, with the discharge voltage being referred to as VC. The grid of the charger 2C is applied the negative grid voltage VG by the grid voltage generating unit 239. The grid voltage VG is considered to be almost equivalent to a surface potential V0 of the photosensitive drum 1C. Therefore, the surface potential V0 of the photosensitive drum 1C can be controlled by adjusting the grid voltage VG.

A developing sleeve of the developing unit 4C is applied a negative bias voltage VB by the developing bias unit 238, with the bias voltage being $|VB|<|V0|$. Accordingly, the surface potential of the developing sleeve becomes VB.

When the laser exposure is performed on the photosensitive drum 1C by the semiconductor laser of the printer head 3C in this state, the voltage of the exposed part on the photosensitive drum 1C increases and becomes a voltage VI. When the voltage VI becomes higher than the developing bias voltage VB, negatively charged toner carried to the surface of the developing sleeve is attracted to the exposed part on the photosensitive drum 1C. The higher a developing voltage ΔV is, the more amount of toner is attracted to the exposed part. Here, the developing voltage ΔV is calculated according to the following equation.

$$\Delta V=|VB-VI|$$

Even when the same level of exposure is always given, the voltage VI changes as the surface potential V0 changes. In addition, a difference between the surface potential V0 and the bias voltage VB cannot be too large or too small. As such, the surface potential V0 and the bias voltage VB are adjusted so that the difference between them can be kept in a predetermined range. Thus, the developing voltage ΔV changes and the amount of toner attracted to the photosensitive drum can be changed.

With this being the situation, the AIDC sensor 22C detects the amount of toner forming the standard toner image formed on the photosensitive drum 1C using a predetermined exposure level, and the VG and the VB are adjusted in accordance with this detection result, so that the density of the standard toner image can remain constant. More specifically, the values of the VG and VB are determined from the detection value of the image density in accordance with a VG/VB correction table shown in FIG. 5 which is experimentally obtained.

(2-A) Transfer Output Control

Figure 6:
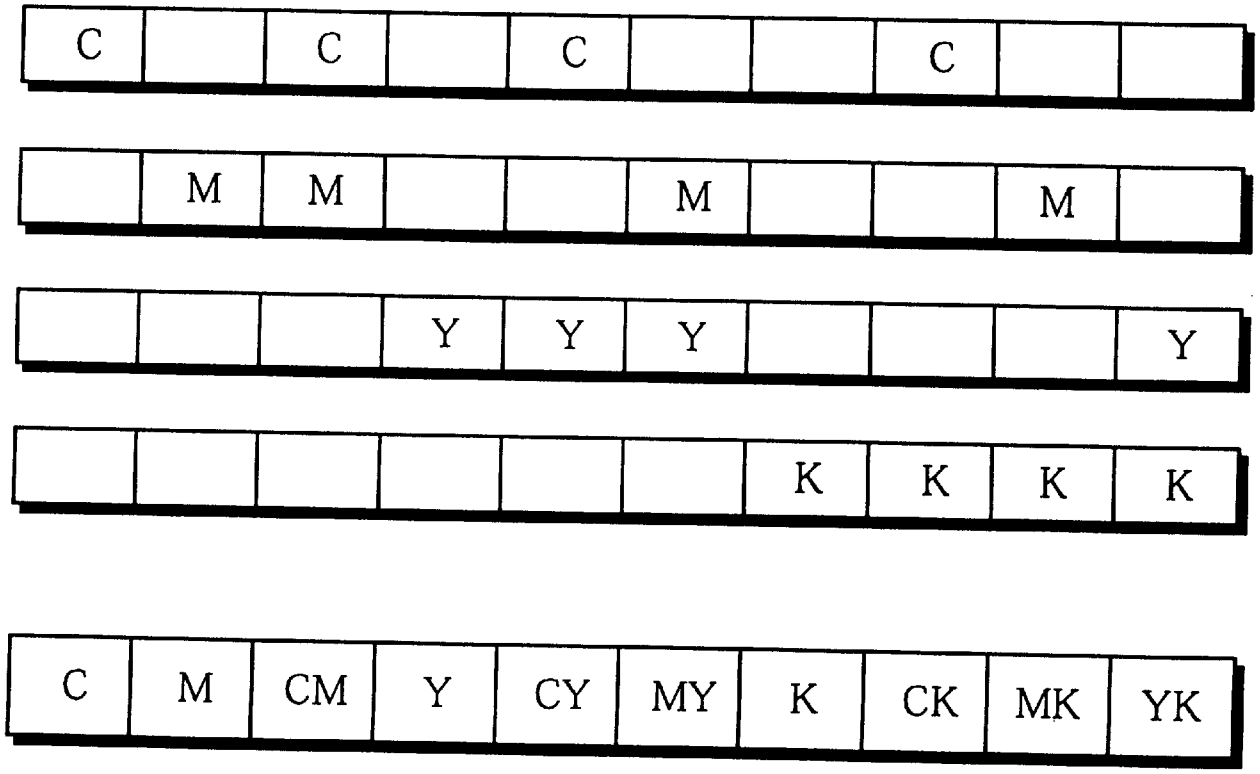
FIGS. 6(*a*) to (*d*) respectively show standard patches of cyan, magenta, yellow, and black, and FIG. 6(*e*) shows a standard patch on which the standard patches (*a*) to (*d*) are superimposed.

To achieve the transfer output control, the transfer output is controlled in accordance with the detection values given by the optical sensors 23 to 26 which respectively detect the amounts of toner on the transport belt 10. In this case, the standard patch that can be detected by the optical sensors 23 to 26 need to be transferred onto the transport belt 10. FIGS. 6(*a*) to (*e*) show the construction of the standard patch. As shown in these figures, by superimposing the standard patches for different colors respectively formed on the photosensitive drums 1C to 1K, the standard patch shown in FIG. 6(*e*) is formed on the transport belt 10. In the present embodiment, the photosensitive drums for cyan, magenta, yellow, and black are arranged in this order in the transport direction of the recording sheet. For this reason, the standard patch is transferred onto the transport belt 10 as shown in FIG. 6(*e*). It should be obvious that this standard patch can be changed according to the arrangements of the photosensitive drums.

This standard patch is formed a predetermined number of times, with the transfer output being changed for each time. The optical sensors 23 to 26 respectively detect the amounts of toner every time the standard patch is formed. Then, an optimum transfer output is obtained. In the present embodiment, the standard patch is formed three times, that is, the amount of toner for each color is also detected three times. Note that the transfer outputs are set so that a relation among transfer outputs Tc to Tk of the transfer brushes 5C to 5K becomes Tc<Tm<Ty<Tk.

Figure 7B:
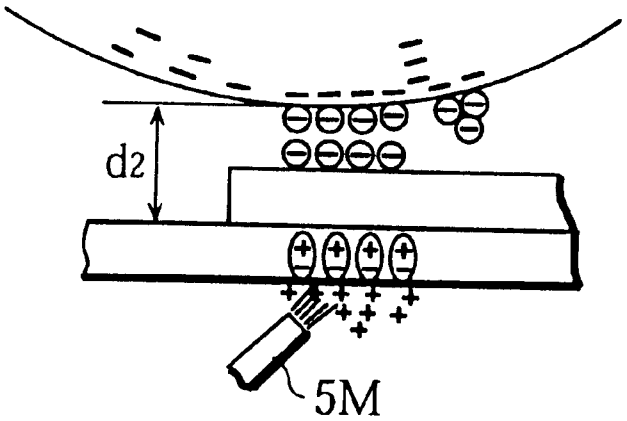
FIG. 7B is a representation showing toner attracted at a transfer position of a photosensitive drum for magenta.
Figure 7A:
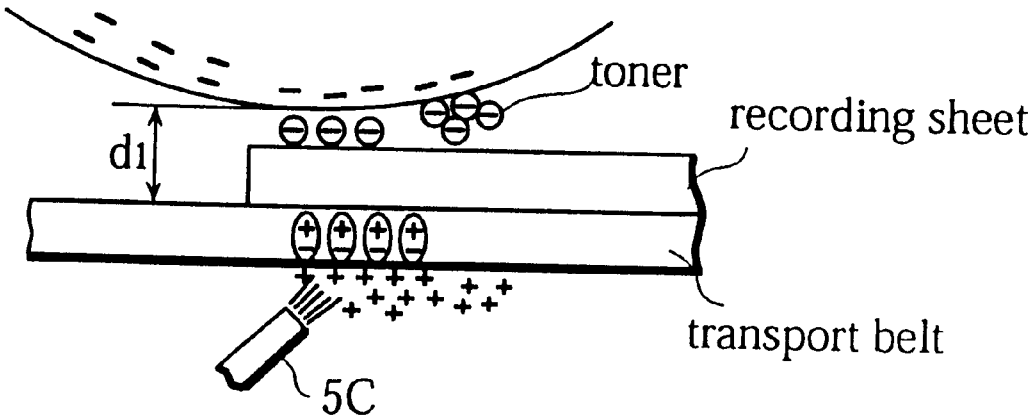
FIG. 7A is a representation showing toner attracted at a transfer position of a photosensitive drum for cyan.

More specifically, when toner on the photosensitive drum 1M is attracted to a recording sheet as shown in FIG. 7B after toner on the photosensitive drum IC has been attracted to the recording sheet as shown in FIG. 7(*a*), a distance d2 between the photosensitive drum 1M and the transport belt 10 is longer than a distance d1 between the photosensitive drum 1C and the transport belt 10 by the toner attracted at the transfer position of the photosensitive drum 1C. The electric field to attract toner becomes weaker as the toner is away from the field, so that the transfer output needs to be increased by the longer distance. The same situation occurs when toner on the photosensitive drum 1K is attracted to the recording sheet after toner on the photosensitive drum 1Y has been attracted to the recording sheet. For this reason, each of the transfer outputs Tm to Tk of the transfer brushes 5M to 5K needs to be made higher each time than the preceding one so that the relation Tc<Tm<Ty<Tk is maintained.

Each transfer output of the transfer brushes 5C to 5K can be determined, with the level of the transfer output being varied for each time. The values of the transfer output are stored in a look-up table as shown in FIG. 8 that is stored in the ROM 203. Also, a table shown in FIG. 9 is stored in the ROM 203, and each transfer output is set in accordance with this table. Note that each column in FIG. 9 indicates a table number indicated in FIG. 8.

The following is a description as to how the transfer output is adjusted in accordance with the amount of toner detected from the standard patch formed under the transfer output which is changed three times. Here, suggest that detection results obtained from the three standard patches are as shown in FIG. 10.

Figure 11:
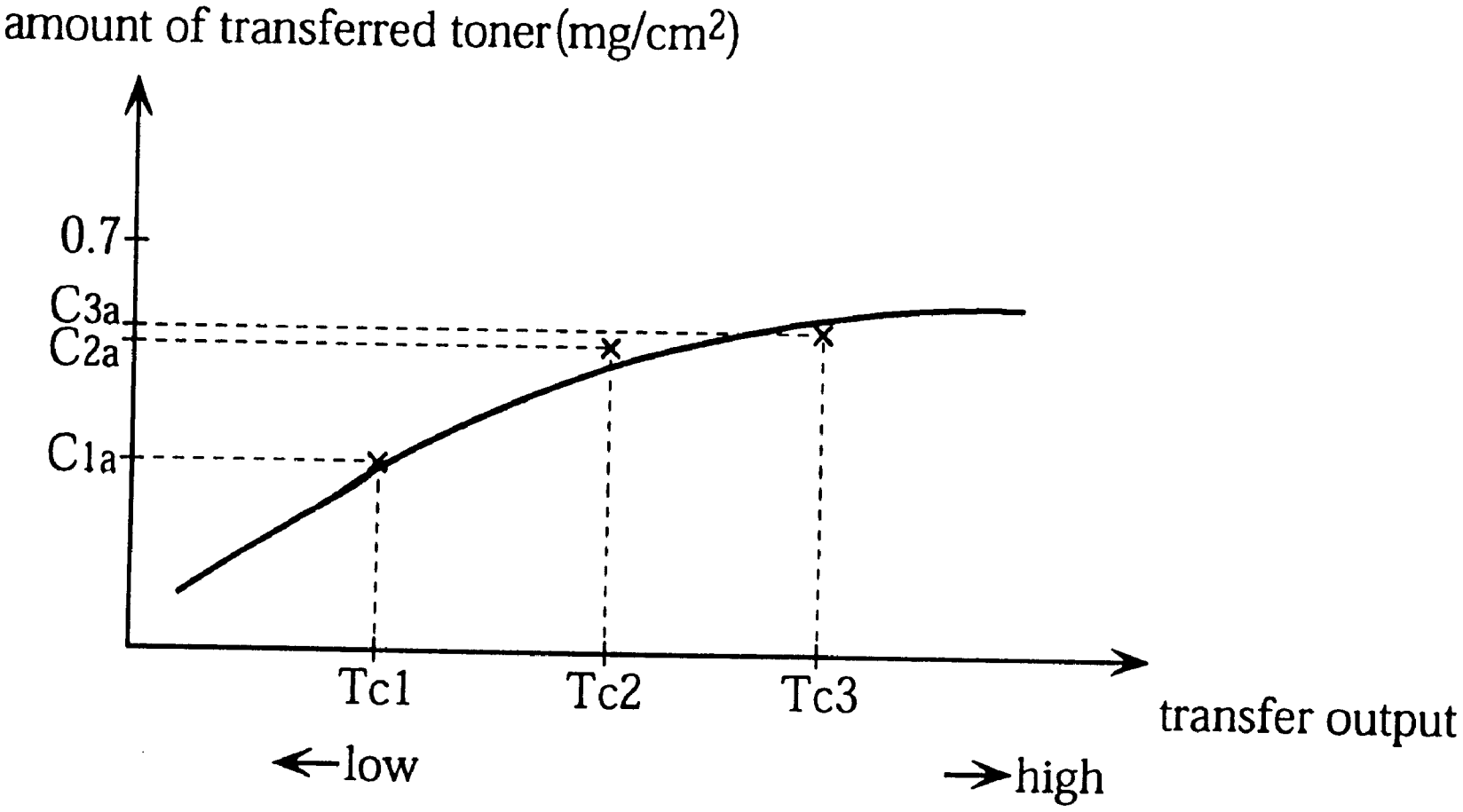
FIG. 11 is a graph example showing the amount of attracted cyan toner for each transfer output at the transfer position of the photosensitive drum for cyan.

A transfer output Tcg of the transfer brush 5C is determined by referring to only the value of the cyan standard patch detected by the optical sensor 23. When the detection result is given by the optical sensor 23 as shown in FIG. 11, for example, the transfer output Tcg is determined at Tc3 where the highest amount of toner is attracted.

Figure 12:
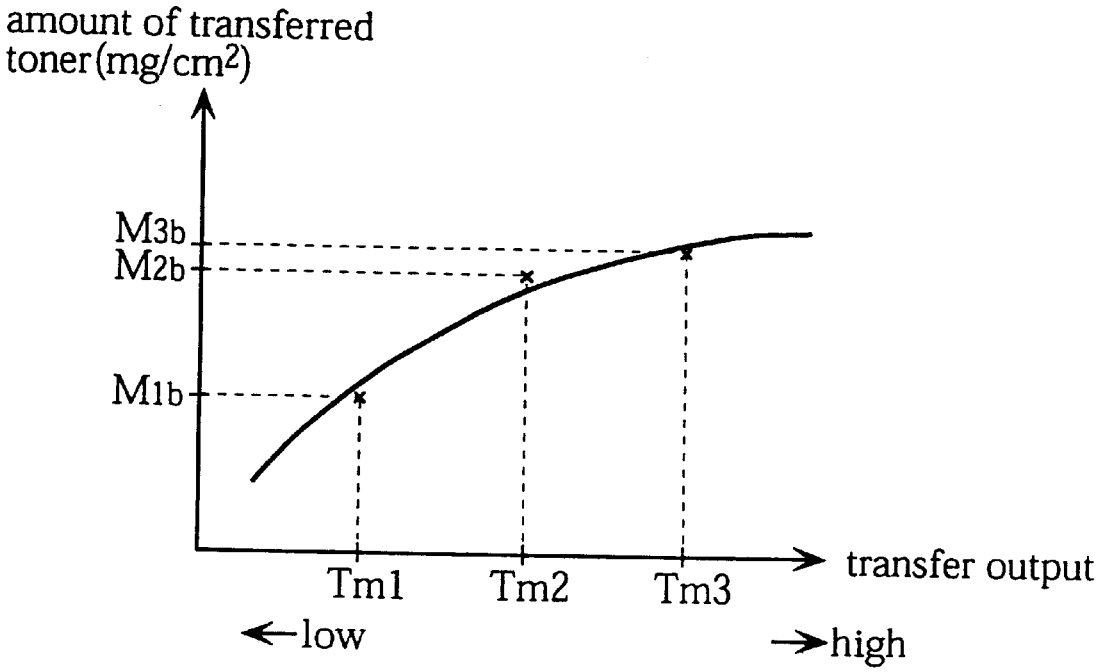
FIG. 12 is a graph example showing the amount of attracted magenta toner for each transfer output at the transfer position of the photosensitive drum for magenta.

A transfer output Tmg of the transfer brush 5M is determined by referring to the values of standard patches of cyan, magenta, and mixed color of cyan and magenta detected by the optical sensors 23 and 24. As is the case with the transfer output Tcg, the transfer output is determined so that the highest amount of toner is attracted. More specifically, when the detection result is given by the optical sensor 24 as shown in FIG. 12, for example, the transfer output is determined at Tm3 where the highest amount of toner is attracted.

Next, the transfer output is determined so that the reattracted toner is minimized. The reattracted toner is obtained by the difference of cyan toner amounts between before and after the photosensitive drum 1M. In this case, the reattracted toner is obtained for two cases when magenta toner is not attracted at the transfer position of the photosensitive drum 1M and when magenta toner is attracted at the transfer position of the photosensitive drum 1M. When magenta toner is not attracted at the transfer position of the photosensitive drum 1M, the reattracted cyan toner is obtained by the difference between the values detected before and after the photosensitive drum 1M according to an equation Cxa−Cxb, with the value of x being 1, 2, or 3.

Meanwhile, when magenta toner is attracted at the transfer position of the photosensitive drum 1M, the reattracted cyan toner is calculated according to an equation Cxa−(CMxb−Mxb), with the value of x being 1, 2, or 3. More specifically, the amount of cyan toner in the standard patch of mixed color of cyan and magenta is calculated according to an equation CMxb−Mxb, so that the reattracted cyan toner in a case when the magenta toner is attracted is obtained by subtracting the calculated value from the amount of cyan toner Cxa detected before the photosensitive drum 1M.

Figure 13:
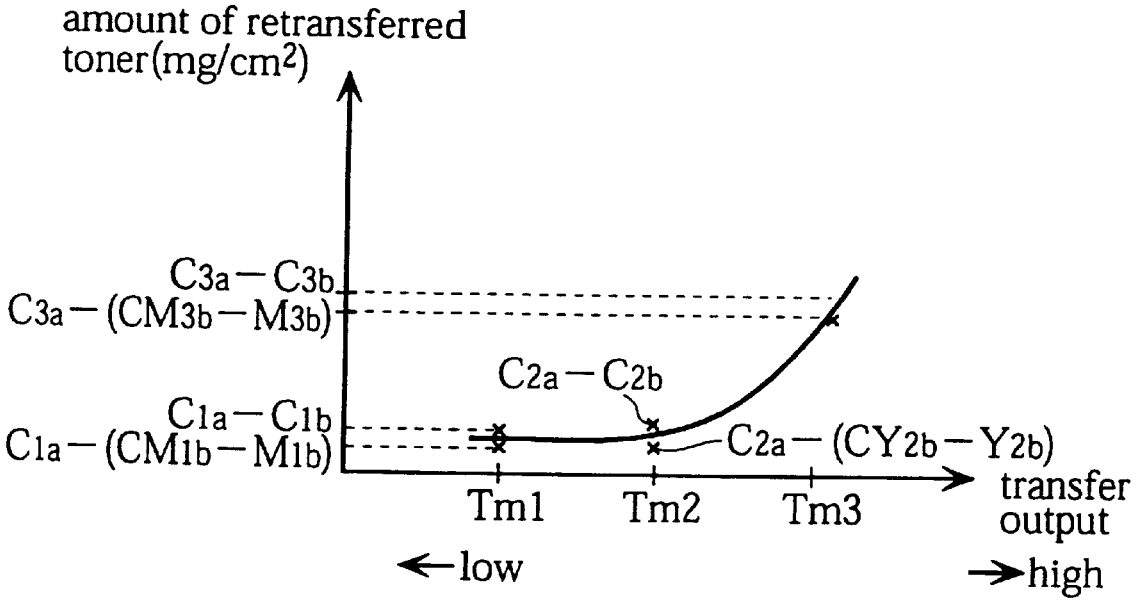
FIG. 13 is a graph example showing the amount of reattracted cyan toner for each transfer output at the transfer position of the photosensitive drum for magenta.

FIG. 13 shows the result obtained from these equations. The average of values obtained from the equations Cxa−Cxb and Cxa−(CMxb−Mxb) is taken for each time. The smallest averages are calculated at Tm1 and Tm2 as shown in FIG. 13. In this case, Tm2 is selected for its larger transfer output to avoid transfer deterioration on the reproduced image.

Then, the transfer output Tmg is calculated by taking the average of the transfer output Tm3 where the transfer density is maximized and the transfer output Tm2 where the reattracted toner is minimized. Specifically, the transfer output Tmg is obtained from an equation (Tm3+Tm2)/2.

Figure 14:
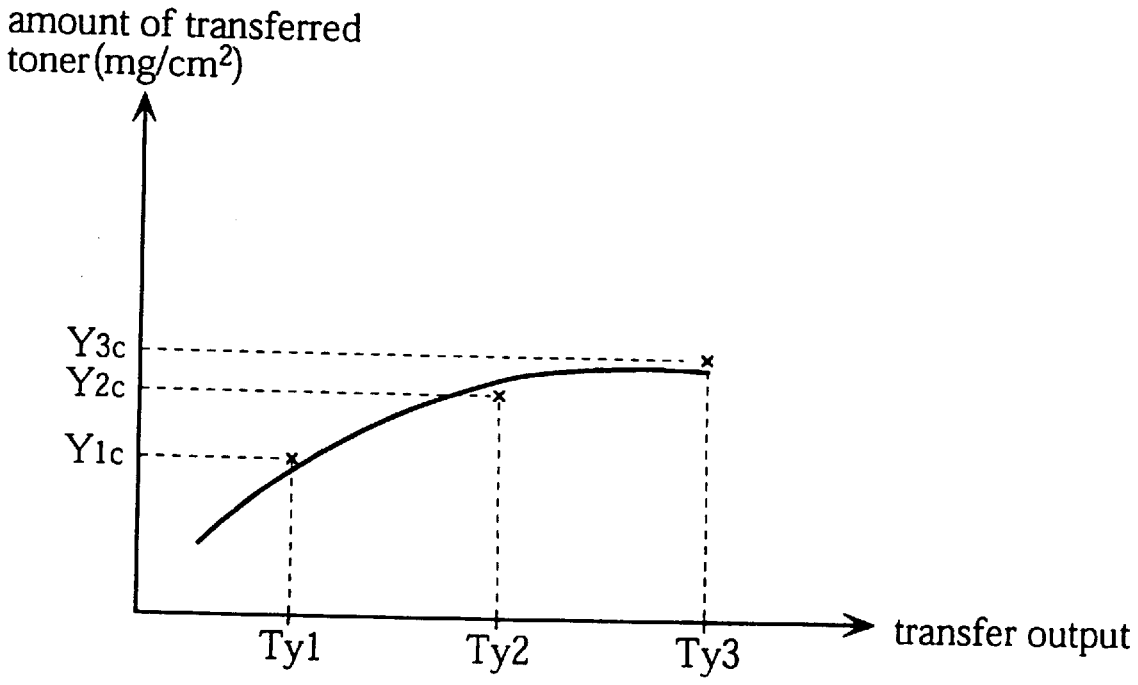
FIG. 14 is a graph example showing the amount of attracted yellow toner for each transfer output at the transfer position of the photosensitive drum for yellow.

Next, a transfer output Tyg of the transfer brush 5Y is determined according to the detection values obtained from the standard patches of cyan, magenta, yellow, mixed color of cyan and yellow, and mixed color of magenta and yellow which are detected by the optical sensors 24 and 25. First, as with the stated cases, the transfer output is determined so that the amount of toner attracted by the transfer brush 5Y is maximized. When the detection result of the yellow standard patch is given by the optical sensor 25 as shown in FIG. 14, for example, a transfer output Ty3 is determined so that the attracted toner is maximized.

Then, the transfer output is determined so that the reattracted toner is minimized. It should be noted here that cyan toner and magenta toner have been attracted to the transport belt 10, and therefore, the transfer output needs to be determined so that both of the reattracted toner of cyan and magenta are minimized.

First, the transfer output is determined to minimize the reattracted cyan toner. As is the case with the transfer brush 5M, the reattracted cyan toner is obtained by the difference of cyan toner amounts between before and after the photosensitive drum 1Y. Also, the reattracted toner is obtained for two cases when yellow toner is not attracted at the transfer position of the photosensitive drum 1Y and when yellow toner is attracted to magenta toner at the transfer position of the photosensitive drum 1Y.

Figure 15:
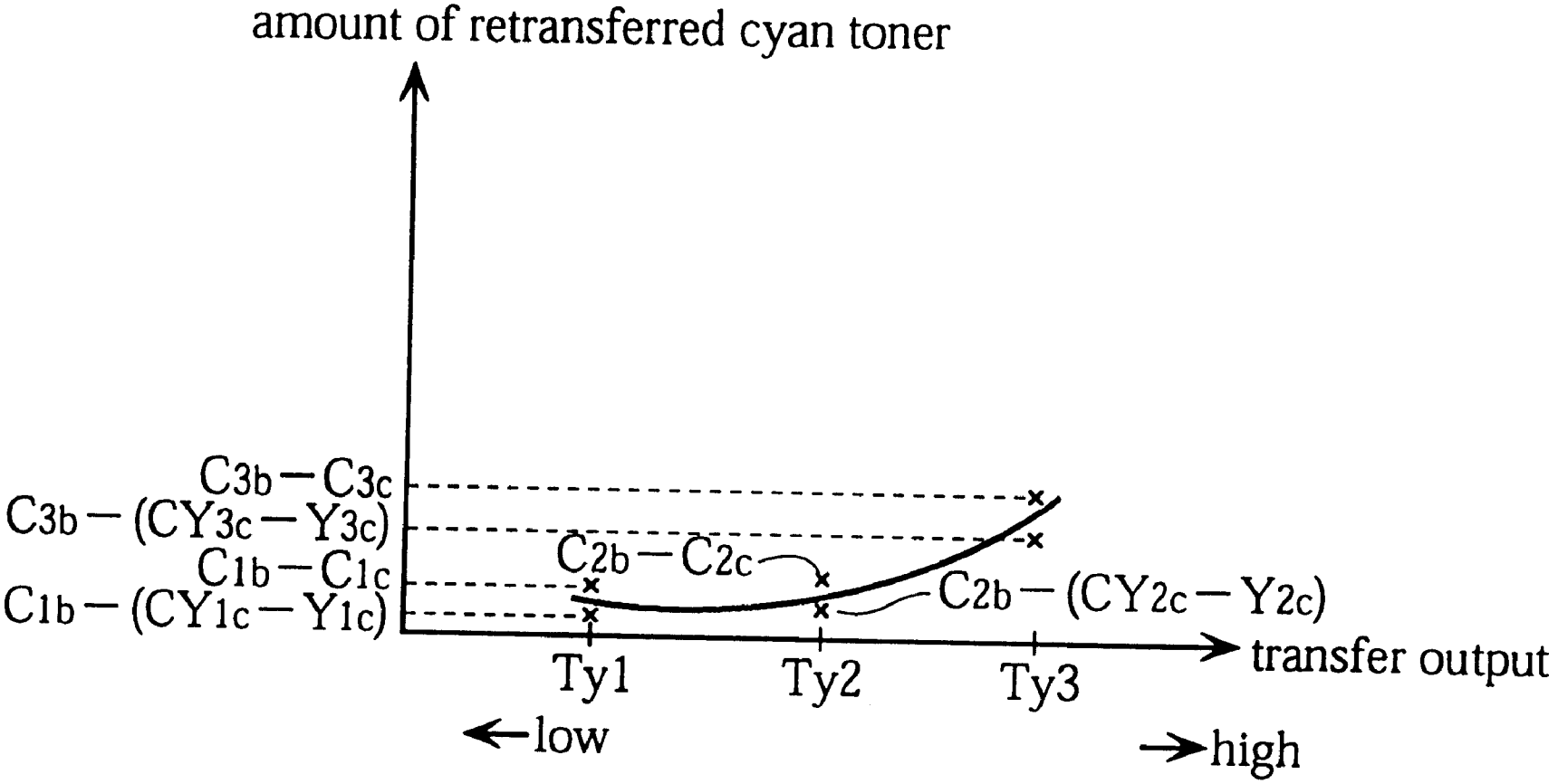
FIG. 15 is a graph example showing the amount of reattracted cyan toner for each transfer output at the transfer position of the photosensitive drum for yellow.

When the yellow toner is not attracted at the transfer position of the photosensitive drum 1Y, the reattracted cyan toner is obtained by the difference between the values detected before and after the photosensitive drum 1Y according to an equation Cxb−Cxc, with the value of x being 1, 2, or 3. When the yellow toner is attracted at the transfer position of the photosensitive drum 1Y, the reattracted cyan toner is calculated according to an equation Cxb−(CYxc−Yxc), with the value of x being 1, 2, or 3. FIG. 15 shows the result obtained from these equations. As is the case with the transfer brush 5M, the transfer output of the transfer brush 5Y is determined at Ty2.

Figure 16:
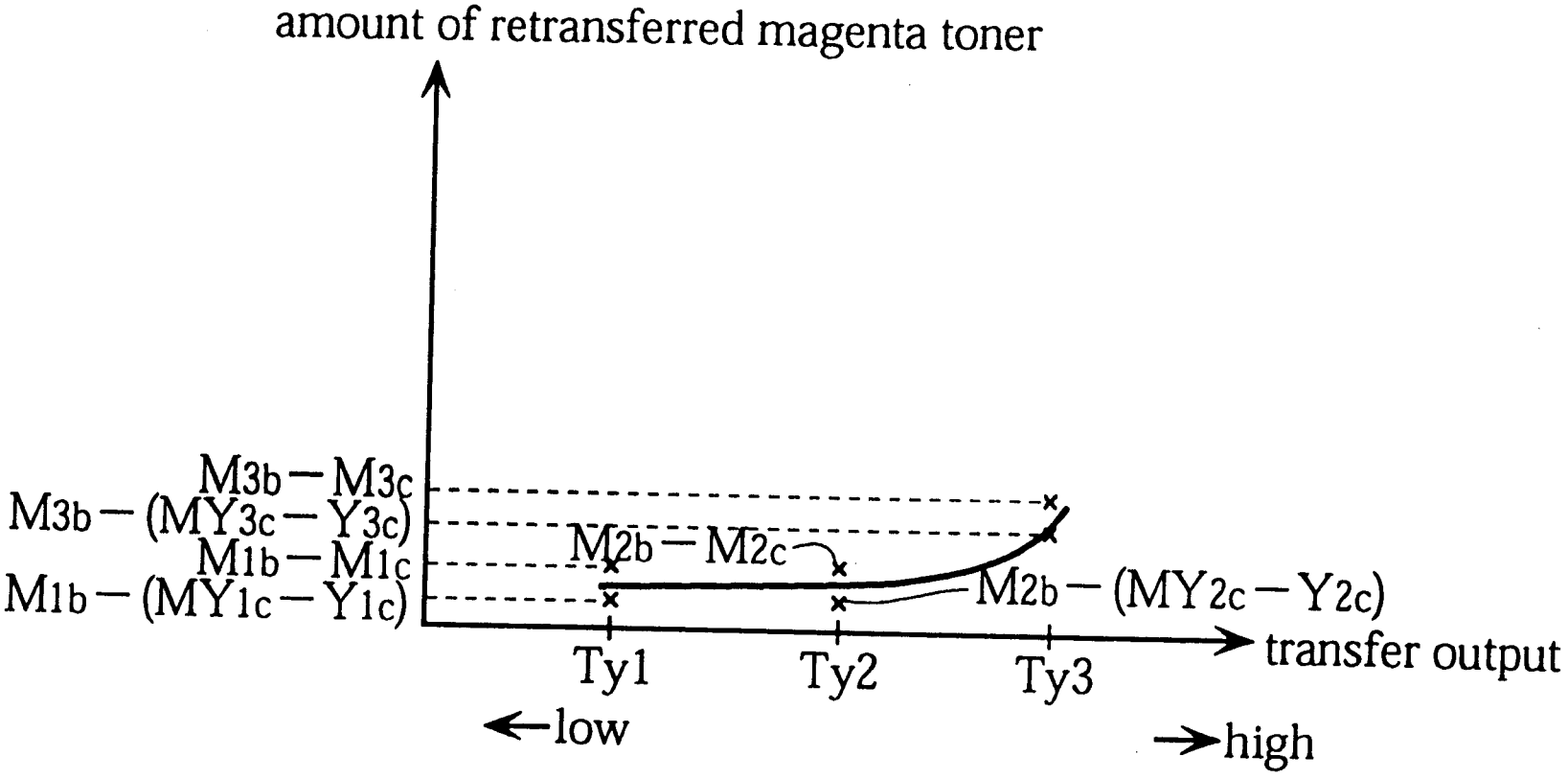
FIG. 16 is a graph example showing the amount of reattracted magenta toner for each transfer output at the transfer position of the photosensitive drum for yellow.

Meanwhile, when yellow toner is not attracted at the transfer position of the photosensitive drum 1Y, the reattracted magenta toner is obtained from an equation Mxb−Mxc, with the value of x being 1, 2, or 3. When yellow toner is attracted at the transfer position of the photosensitive drum 1Y, the reattracted magenta toner is obtained from an equation Mxb−(MYxc−Yxc), with the value of x being 1, 2, or 3. FIG. 16 shows the result obtained from these equations. In the same way as stated, the transfer output of the transfer brush 5Y is determined at Ty2.

The transfer output Tyg is obtained by taking the average of the three values calculated as described above, using an equation (Ty3+Ty2+Ty2)/3.

In the same way, a transfer output Tkg of the transfer brush 5K is determined. However, the transfer output needs to be determined so that the reattracted toner of cyan, magenta, and yellow are minimized. More specifically, transfer outputs Tkr, Tks, and Tkp are respectively calculated to minimize each reattracted toner of cyan, magenta, and yellow. Also, a transfer output Tkq is calculated to maximize the attracted black toner. Then, the transfer output Tkg is obtained by taking the average of the four values using an equation (Tkr+Tks+Tkp+Tkq)/4.

(2-B) γ Correction Control

The following is a description of adjustment control of a γ correction value in accordance with a transfer efficiency. The "transfer efficiency" referred to in the present specification means a ratio of the amount of toner remaining immediately before the fixing unit 19 to the amount of toner which was attracted at the corresponding image forming unit. Note that the calculation of the transfer efficiency is described later in this specification.

Figure 17:
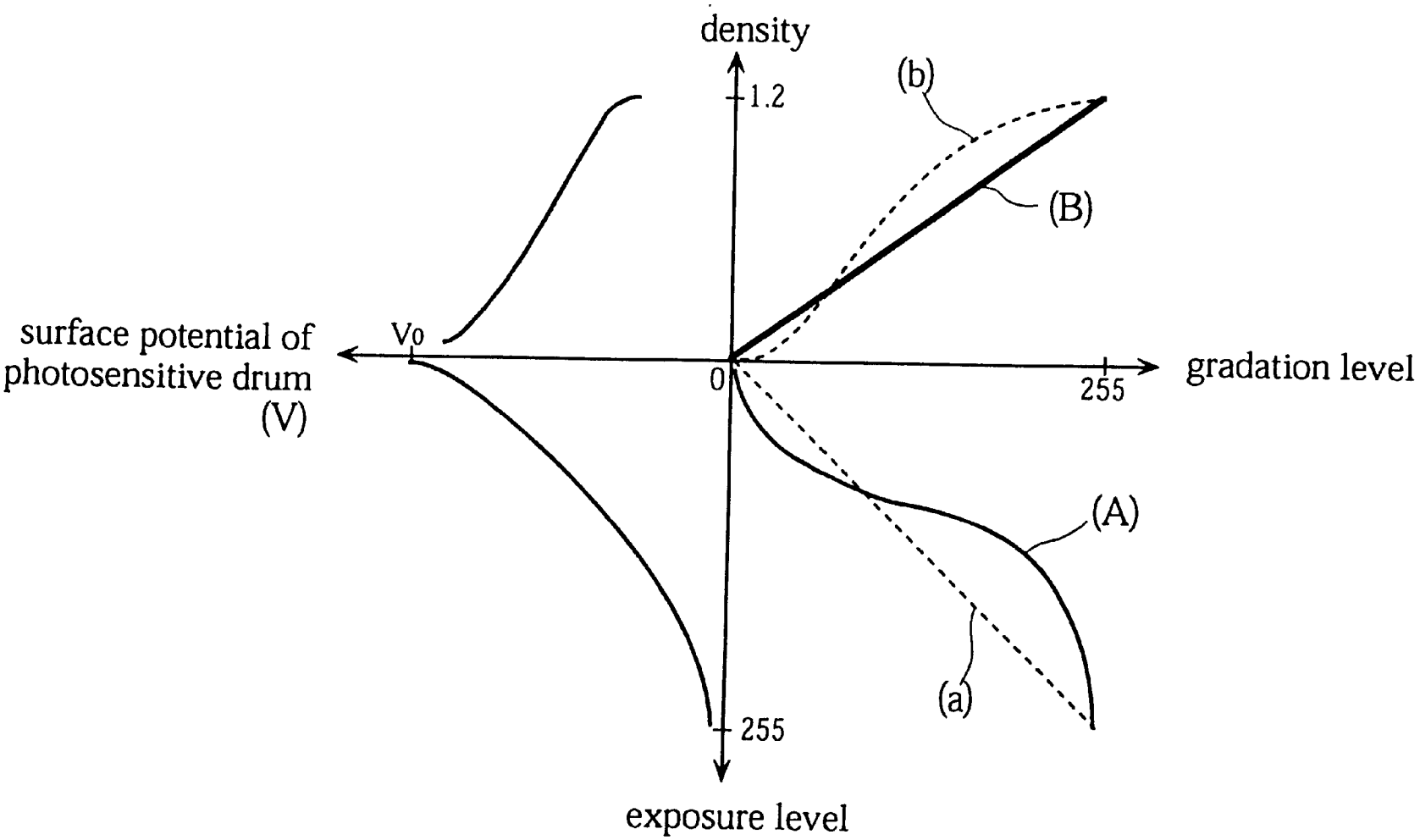
FIG. 17 shows a correlation among a gradation level, an a exposure level, a surface potential of a photosensitive drum, and a density of a reproduced image.

The γ correction control is first explained. Usually, if a laser beam is linearly emitted from the laser diode, with the intensity level of the laser diode being proportional to a gradation level, the gradation on the reproduced image is not linear due to the light decay characteristics of the photosensitive drums and the developing characteristics, both of which include no linear characteristics. These characteristics are represented in FIG. 17. FIG. 17 also shows the correlation among a gradation level, an exposure level, a surface potential of a photosensitive drum, and a density of a reproduced image. As shown in this figure, when the exposure level linearly increases proportional to the gradation level as indicated by the dashed line (a), the density of the reproduced image is represented by a curve as indicated by the dashed line (b), not being proportional to the gradation level.

As such, a correction is required so that the exposure level changes proportional to the gradation level as indicated by the solid line (A), thereby making the density of the reproduced image linearly change proportional to the gradation level as indicated the solid line (B). This correction is referred to as the γ correction. The change of the exposure level as indicated by the solid line (A), namely, the γ correction, needs to be adjusted in accordance with the changes of the light decay characteristics and the other characteristics.

More specifically, since the γ correction for making the change of density linear relates to the amount of attracted toner, a table is stored for showing the γ correction values corresponding to the amounts of toner attracted to the photosensitive drums that are detected by the AIDC sensors. Using this table, the γ correction is determined in accordance with the detection values given by the AIDC sensors.

FIG. 18 shows an example of the γ correction table. As shown in this figure, the exposure level corresponding to a gradation level is stored for each table number in the γ correction table. In addition, the γ correction table numbers corresponding to the attracted toner detected by the AIDC sensor are stored in the VG/VB correction table shown in FIG. 5.

Usually, the γ correction is determined only by the values given by the AIDC sensors. However, even if the transfer output is set to minimize the reattracted toner as described above, cyan toner having attracted at the transfer position of the photosensitive drum 1C may be reattracted three times before reaching the fixing unit 19. In the same way, magenta toner may be reattracted two times and yellow toner may be reattracted once. As such, even when the γ correction value is obtained from the attracted toner on the photosensitive drum, the γ correction may not be correctly performed due to the adverse effect of these reattractions.

To address this problem, the γ correction value is further adjusted in consideration of the reattracted toner. More specifically, the transfer efficiency is calculated for each color toner, and the exposure level in the γ correction table shown in FIG. 18 is divided by the calculated transfer efficiency. As one example, when the transfer efficiency is 0.9, the exposure level should be set at 18 according to the γ correction table. However, the actual exposure level is set at 20 according to an equation 18/0.9. When the transfer efficiency is low, the amount of toner attracted to the photosensitive drum needs to be increased. For this reason, the exposure level is divided by the transfer efficiency, thereby increasing the exposure level by the low transfer efficiency.

The transfer efficiency is presented by a ratio between the density detected by the optical sensor 26 set immediately before the fixing unit 19 and the density detected by the corresponding optical sensor 23 to 25 respectively set immediately after the photosensitive drums 1C to 1Y. More specifically, using FIG. 10, the transfer efficiency of cyan toner is presented by Cd/Ca, in accordance with the value Cd detected by the sensor 26 and the value Ca detected by the sensor 23 under the transfer output Tcg.

The transfer efficiency of magenta toner is presented by Md/Mb, in accordance with the value Md detected by the sensor 26 and the value Mb detected by the sensor 24 under the transfer output Tmg. In this case, however, the standard patch was not actually formed under the transfer output Tmg, so that the values of Md and Mb are respectively obtained by taking the average among the values detected by the sensors 26 and 23 under each transfer output set for determining the transfer output Tmg. The transfer efficiency of yellow toner is presented by Yd/Yc, in accordance with the value Yd detected by the sensor 26 and the value Yc detected by the sensor 25 under the transfer output Tyg. Here, as is the case with magenta toner, the values of Yd and Yc are obtained by taking the average among the values detected by the sensors 26 and 24 under each transfer output set for determining the transfer output Tyg.

(3) Control Operation

The following is a description of the operations for controlling the transfer output and the γ correction of the image forming apparatus having the stated construction. These control operations are performed as subroutines included in the main routine (not shown) of the image forming apparatus. These subroutines are activated by predetermined conditions.

Figure 19:
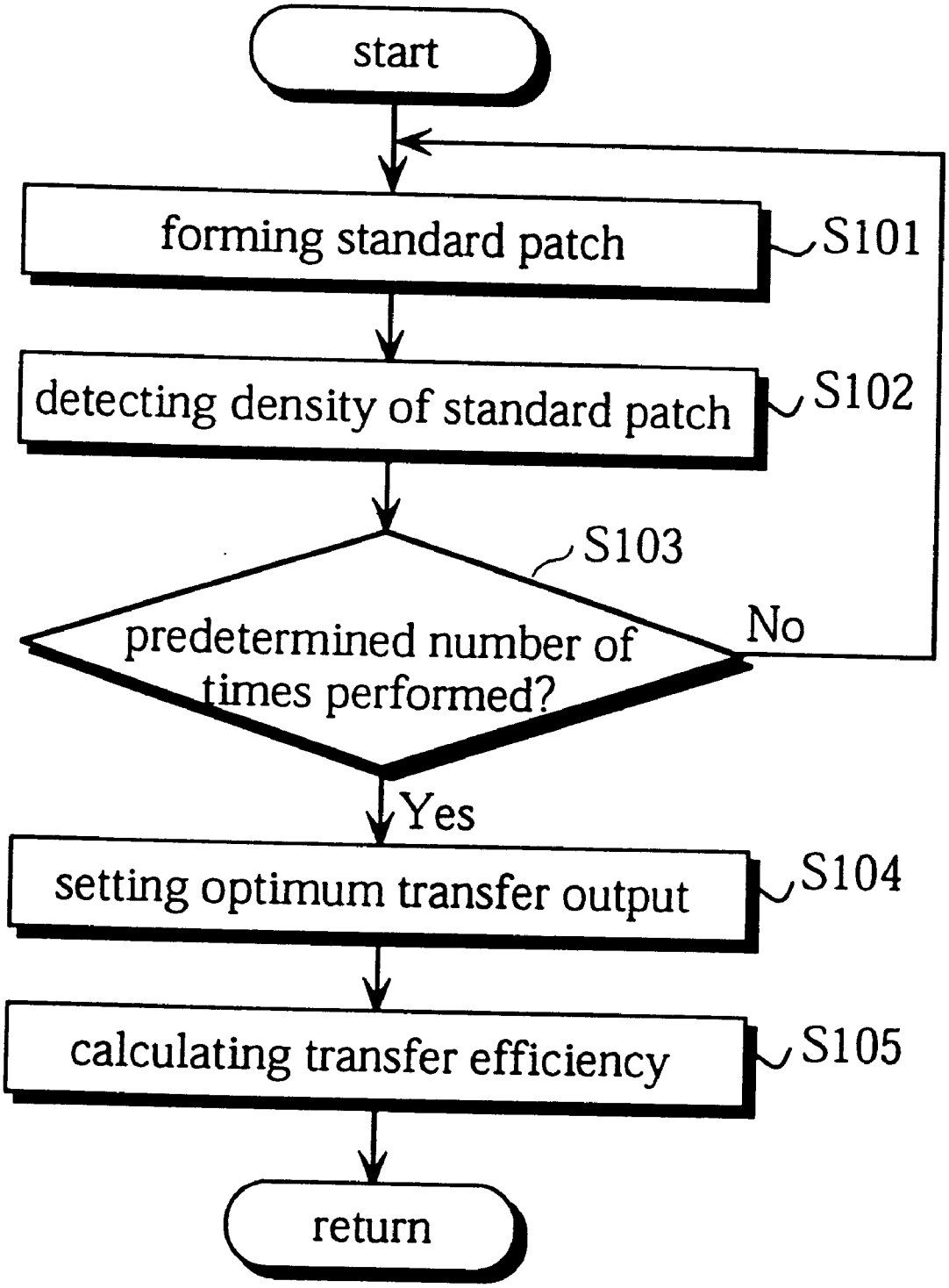
FIG. 19 is a flowchart showing the processing for controlling the transfer output.

FIG. 19 is a flowchart showing the operation for controlling the transfer output. When a copying operation is performed, this control operation is performed before the image formation is performed in the copying operation. First, the standard patch shown in FIG. 10 is formed on the transport belt 10 under the transfer outputs Tc to Tk of the transfer brushes 5C to 5K according to the table shown in FIG. 9 (step Then, each amount of toner on the standard patch is detected by the corresponding optical sensor 23 to 26 and stored (step S102). The steps S101 and S102 are performed a predetermined number of times, three times in the present embodiment (step S103).

After this, the transfer outputs Tcg to Tkg of the transfer brushes 5C to 5K are determined in accordance with the attracted toner and the reattracted toner as described above (step S104). The transfer efficiencies are also calculated in accordance with the detection results (step S105). These transfer efficiencies are stored in a predetermined storage area.

Figure 20:
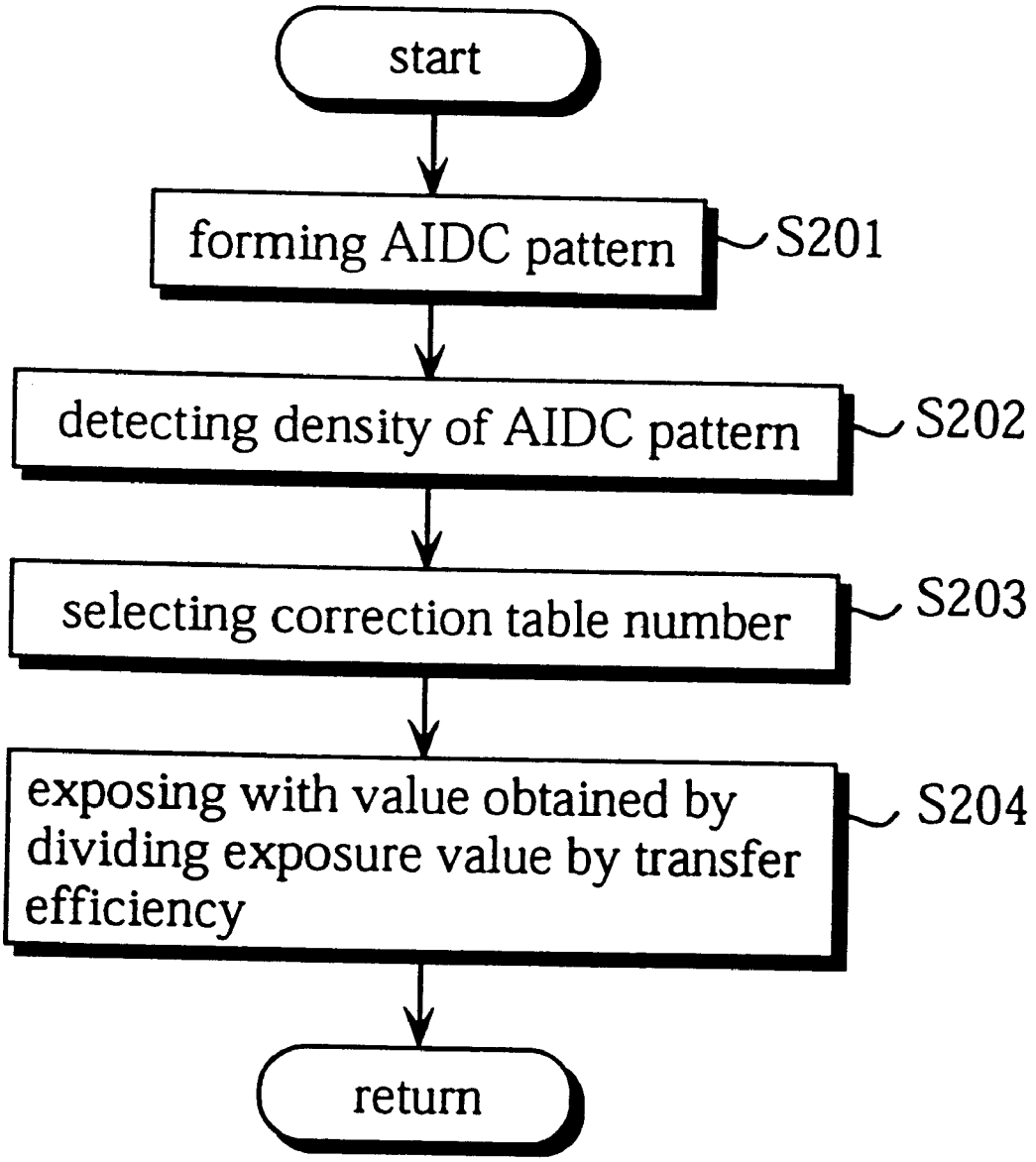
FIG. 20 is a flowchart showing the processing for the $\gamma$ correction control.

Then, the γ correction is performed and the copying operation follows. FIG. 20 is a flowchart showing the operation of the γ correction control. This subroutine is performed for each page of recording sheets.

The AIDC pattern is formed on a predetermined part of each photosensitive drum (step S201). The amount of toner forming the AIDC pattern is detected by the corresponding AIDC sensor (step S202), and the γ correction table number is selected from the VG/VB correction table shown in FIG. 5 in accordance with the detection value (step S203). According to the table of the selected γ correction table number, the exposure level is determined corresponding to the gradation level of the image to be formed. Then, the semiconductor laser driver is driven to emit the semiconductor laser based on the value obtained by dividing the determined exposure level by the calculated transfer efficiency (step S204). Consequently, the exposure level is adjusted in consideration of the reattracted toner.

(4) Modifications

In the present embodiment, the transfer outputs and the γ correction values are adjusted using the amounts of attracted and reattracted toner obtained from the detection values given by the optical sensors 23 to 26. These amounts of attracted and reattracted toner may be used for adjusting other image forming conditions, such as the grid voltage and the developing bias voltage. More specifically, although the γ correction value is adjusted by dividing the γ correction value by the transfer efficiency in the present embodiment, the amount of toner may be adjusted by dividing the detection value of the AIDC sensor by the transfer efficiency and the table number may be selected from the VG/VB correction table shown in FIG. 5 in accordance with the adjusted amount of toner. In this way, the grid voltage VG and the developing bias voltage VB as well as the γ correction can be adjusted in accordance with the reattracted toner.

In the present embodiment, the reattracted toner is obtained by the difference of the toner amounts between before and after the corresponding transfer position. However, the ratio of the toner amount before and after the corresponding transfer position may be obtained. As a result, the amount of reattracted toner may be judged to be large when the ratio is high and judged to be small when the ratio is low.

In the present embodiment, the transfer output is determined by taking the average value between the highest amount of attracted toner and the lowest amount of attracted toner. The value is not limited to the average value. For example, if the reattracted toner is given a high priority, the transfer output is calculated by assigning weights so that the reattracted toner is minimized. Thus, various methods may be used, depending on prioritization of the attracted toner and the reattracted toner.

In the present embodiment, when the standard patch is formed, the transfer outputs Tc to Tk of the transfer brushes 5C to 5K are determined using the table shown in FIG. 9. However, different tables corresponding to the surrounding conditions may be used. For example, when the humidity is high and a value of the humidity sensor 213 is above a predetermined value, toner is easily attracted to the recording sheet, so that a table where values of the transfer outputs Tc to Tk are relatively low as shown in FIG. 21(A) may be used. Meanwhile, when the humidity is low and a value of the humidity sensor 213 is below a predetermined value, toner is hardly attracted to the recording sheet, so that a table where values of the transfer outputs Tc to Tk are relatively high as shown in FIG. 21B may be used.

Although the reattracted toner is obtained for each single color in the present embodiment, the amount of reattracted mixed color toner may be obtained. For example, when yellow toner is not attracted at the transfer position of the photosensitive drum 1Y, the amount of reattracted mixed color toner of magenta and cyan may be calculated according to an equation CMxb−CMxc. Meanwhile, when yellow toner is attracted at the transfer position of the photosensitive drum 1Y, the standard patch where cyan, magenta, and yellow are superimposed may be formed and the amount of reattracted mixed color toner of magenta and cyan may be calculated according to an equation CMxb−(CMYxc−Yxc), with CMYxc being the detection value of the sensor 25.

The standard patch is formed on the transport belt 10 in the present embodiment. However, the standard patch may be formed on the recording sheet transported on the transport belt 10, and may be detected by the optical sensors 23 to 26.

In the present embodiment, the standard toner images formed on the photosensitive drums are detected by the AIDC sensors, and the grid voltage VG, the developing bias voltage VB, and the γ correction table number are selected from the VG/VB correction table shown in FIG. 5. However, the standard toner images may be formed on the transport belt 10 and detected by the optical sensors 23 to 26. In accordance with the detection values, the grid voltage VG, etc may be selected. As a result, the number of the optical sensors can be reduced, thereby reducing cost.

Although the present invention has been fully described by way of examples with reference to the accompanying drawings, it is to be noted that various changes and modifications will be apparent to those skilled in the art.

Therefore, unless such changes and modifications depart from the scope of the present invention, they should be constructed as being included therein.

What is claimed is:

1. An image forming apparatus comprising:

a first image forming unit for forming a first electrostatic latent image on a first image holding component and for transferring a toner image obtained by developing the first electrostatic latent image onto a transfer material which is moving;

a second image forming unit, being located at a downstream side of the first image forming unit in a moving direction of the transfer material, for forming a second electrostatic latent image on a second image holding component and for transferring a toner image obtained by developing the second electrostatic latent image onto the transfer material;

a pattern image formation controlling unit for having the first image forming unit form a pattern image on the transfer material, with the pattern image being used for determining an image forming condition;

a density detecting unit for detecting a density of the pattern image formed on the transfer material as a first density detection value before the pattern image passes by the second image forming unit and for detecting a density of the pattern image formed on the transfer material as a second density detection value after the pattern image passes by the second image forming unit; and an image forming condition setting unit for comparing the first density detection value with the second density detection value, for determining the image forming condition in accordance with a comparison result, and for setting the image forming condition for an image formation performed by the second image forming unit.

2. The image forming apparatus of claim 1, wherein the first image forming unit includes a transfer unit for transferring the toner image onto the transfer material, wherein the pattern image formation controlling unit has the first image forming unit form the pattern image at least three times and makes a transfer output of the transfer unit different for each time, and wherein the image forming condition setting unit compares the first density detection value with the second density detection value every time a pattern image is formed and determines the image forming condition in accordance with all comparison results for an image formation performed by the second image forming unit.

3. The image forming apparatus of claim 1, wherein the second image forming unit a transfer unit for transferring the toner image onto the transfer material, and wherein the image forming condition is a transfer output level of the transfer unit.

4. The image forming apparatus of claim 1, wherein the second image forming unit includes an exposing unit for forming the second electrostatic latent image, wherein the image forming condition is an exposure condition of the exposing unit.

5. A method for determining an image forming condition using an image forming apparatus, the method including:

a first step for transferring a pattern image formed by a first image forming unit onto a transfer material which is moving, with the pattern image being used for determining an image forming condition;

a second step for detecting a density of the pattern image formed on the transfer material as a first density detection value before the pattern image passes by the second image forming unit which is located at a downstream side of the first image forming unit in a moving direction of the transfer material;

a third step for detecting a density of the pattern image formed on the transfer material as a second density detection value after the pattern image passes by the second image forming unit; and a fourth step for comparing the first density detection value with the second density detection value and for determining an image forming condition in accordance with a comparison result for a next image formation performed by the second image forming unit.

6. An image forming apparatus comprising:

a first image forming unit for forming a first electrostatic latent image on a second image holding component and for transferring a toner image obtained by developing the first electrostatic latent image using a color toner onto a transfer material which is moving;

a second image forming unit, being located at a downstream side of the first image forming unit in a moving direction of the transfer material, for forming a second electrostatic latent image on an image holding component and for transferring a toner image obtained by developing the second electrostatic latent image onto the transfer material using a color toner different from the color toner used by the first image forming unit;

a pattern image formation controlling unit for having the first image forming unit form a pattern image on the transfer material, with the pattern image being used for determining an image forming condition;

a first sensor, being located between the first image forming unit and the second image forming unit, for detecting a toner density of the pattern image formed on the transfer material;

a second sensor, being located at a downstream side of a transfer position of the second image forming unit in the moving direction of the transfer material, for detecting a toner density of the pattern image formed on the transfer material; and an image forming condition setting unit for comparing a toner density value given by the first sensor with a toner density value given by the second sensor, for determining the image forming condition in accordance with a comparison result, and for setting the image forming condition for an image formation performed by the second image forming unit.

7. The image forming apparatus of claim 6, wherein the pattern image formation controlling unit further controls the second image forming unit to form a pattern image on the transfer material, with the pattern image being used for determining the image forming condition, and wherein the image forming condition setting unit determines the image forming condition, considering the toner density of the pattern image formed by the second image forming unit that is detected by the second sensor in addition to considering the comparison result.

8. The image forming apparatus of claim 6, wherein the second image forming unit includes a transfer unit for transferring the toner image onto the transfer material, and wherein the image forming condition is a transfer output level of the transfer unit.

9. The image forming apparatus of claim 6, wherein the second image forming unit includes an exposing unit for forming the second electrostatic latent image, wherein the image forming condition is an exposure condition of the exposing unit.

10. An image forming apparatus comprising:

a first image forming unit for forming a first electrostatic latent image on a first image holding component and for transferring a toner image obtained by developing the first electrostatic latent image using a first color toner onto a transfer material which is moving;

a second image forming unit, being located at a downstream side of the first image forming unit in a moving direction of the transfer material, for forming a second electrostatic latent image on a second image holding component and for transferring a toner image obtained by developing the second electrostatic latent image using a second color toner onto the transfer material;

a pattern image formation controlling unit for having the first image forming unit and the second image forming unit respectively form a first pattern image using the first color toner and a second pattern image using the second color toner on the transfer material, whereby a third pattern image where the first pattern image and the second pattern image are superimposed is formed on the transfer material, with each of the first pattern image, the second pattern image, and the third pattern image being used for determining an image forming condition;

a first sensor, being located between the first image forming unit and the second image forming unit, for detecting a toner density of the first pattern image formed on the transfer material;

a second sensor, being located at a downstream side of a transfer position of the second image forming unit in the moving direction of the transfer material, for detecting a toner density of one of the first pattern image, the second pattern image, and the third pattern image formed on the transfer material; and an image forming condition setting unit for determining the image forming condition in accordance with a second comparison result which is obtained by comparing a first comparison result with the detection value of the first pattern image detected by the first sensor, with the first comparison result being obtained by comparing the detection value of the second pattern image detected by the second sensor with the detection value of the third pattern detected by the second sensor, and for setting the image forming condition for an image formation performed by the second image forming unit.

11. The image forming apparatus of claim 10, wherein the image forming condition setting unit determines the image forming condition, considering the detection value of the second pattern image detected by the second sensor in addition to considering the second comparison result.

12. The image forming apparatus of claim 10, wherein the second image forming unit includes a transfer unit for transferring the toner image onto the transfer material, and wherein the image forming condition is a transfer output level of the transfer unit.

13. The image forming apparatus of claim 10, wherein the second image forming unit includes an exposing unit for forming the second electrostatic latent image, wherein the image forming condition is an exposure condition of the exposing unit.

14. An image forming apparatus comprising:

a first image forming unit for forming a first electrostatic latent image on a first image holding component and for transferring a toner image obtained by developing the first electrostatic latent image using a first color toner onto a transfer material which is moving;

a second image forming unit, being located at a downstream side of the first image forming unit in a moving direction of the transfer material, for forming a second electrostatic latent image on a second image holding component and for transferring a toner image obtained by developing the second electrostatic latent image using a second color toner onto the transfer material;

a first sensor, being located between the first image forming unit and the second image forming unit, for detecting a toner density of the toner image formed on the transfer material;

a second sensor, being located at a downstream side of a transfer position of the second image forming unit in the moving direction of the transfer material, for detecting a toner density of the toner image formed on the transfer material; and a controller for having the first image forming unit form a first pattern toner image and a second pattern toner image using the first color toner on the transfer material, and for having the second image forming unit form a third pattern toner image using the second color toner on the transfer material and a fourth pattern toner image using the second color toner superimposed on the second pattern toner image.

15. The image forming apparatus of claim 14, wherein the controller further compares a first detection value of the first pattern toner image detected by the first sensor with a second detection value of the first pattern toner image detected by the second sensor, with a comparison result being a first comparison result, determines an image forming condition in accordance with the first comparison result, and sets the image forming condition for an image formation performed by the second image forming unit.

16. The image forming apparatus of claim 15, wherein the controller determines the image forming condition, considering the detection value of the third pattern toner image detected by the second sensor in addition to considering the first comparison result.

17. The image forming apparatus of claim 14, wherein the controller further determines an image forming condition of the second image forming unit in accordance with a second comparison result which is obtained by comparing a first comparison result with a detection value of the first pattern toner image detected by the first sensor, with the first comparison result being obtained by comparing a detection value of the third pattern toner image detected by the second sensor with a detection value of the fourth pattern toner image detected by the second sensor.

18. The image forming apparatus of claim 17, wherein the controller determines the image forming condition, considering the detection value of the third pattern toner image detected by the second sensor in addition to considering the second comparison result.

19. The image forming apparatus of claim 14, wherein the controller further selects one of a first comparison result and a third comparison result, and determines the image forming condition for an image formation performed by the second image forming unit in accordance with a selected comparison result, wherein the first comparison result is obtained by comparing a first detection value of the first pattern toner image detected by the first sensor with a second detection value of the first pattern toner image detected by the second sensor, and wherein the third comparison result is obtained by comparing a second comparison result with the first detection value of the first pattern toner image detected by the first sensor, with the second comparison result being obtained by comparing a third detection value of the third pattern toner image detected by the second sensor with a fourth detection value of the fourth pattern toner image detected by the second sensor.

20. The image forming apparatus of claim 19, wherein the controller determines the image forming condition of the second image forming unit, considering the third detection value in addition to considering the selected comparison result.

21. An image forming apparatus comprising:

a first image forming unit for forming a first electrostatic latent image on a first image holding component and for transferring a toner image obtained by developing the 1 first electrostatic latent image using a first color toner onto a transfer material which is moving;

a second image forming unit, being located at a downstream side of the first image forming unit in a moving direction of the transfer material, for forming a second electrostatic latent image on a second image holding component and for transferring a toner image obtained by developing the second electrostatic latent image using a second color toner onto the transfer material;

a first post-transfer density detecting sensor, being located between the first image forming unit and the second image forming unit, for detecting a toner density of the toner image formed on the transfer material;

a second post-transfer density detecting sensor, being located at a downstream side of a transfer position of the second image forming unit in the moving direction of the transfer material, for detecting a toner density of the toner image formed on the transfer material;

a first pre-transfer density detecting sensor for detecting a toner density of the toner image formed on the image holding component of the first image forming unit; and a second pre-transfer density detecting sensor for detecting a toner density of the toner image formed on the image holding component of the second image forming unit.

22. The image forming apparatus of claim 21 further comprising:

a third image forming unit, being located at a downstream side of the second image forming unit in the moving direction of the transfer material, for forming a third electrostatic latent image on a third image holding component and for transferring a toner image obtained by developing the third electrostatic latent image using a third color toner onto the transfer material;

a fourth image forming unit, being located at a downstream side of the third image forming unit in the moving direction of the transfer material, for forming a fourth electrostatic latent image on a fourth image holding component and for transferring a toner image obtained by developing the fourth electrostatic latent image using a fourth color toner onto the transfer material;

a third post-transfer density detecting sensor, being located between the third image forming unit and the fourth image forming unit, for detecting a toner density of the toner image formed on the transfer material;

a fourth post-transfer density detecting sensor, being located at a downstream side of a transfer position of the fourth image forming unit in the moving direction of the transfer material, for detecting a toner density of the toner image formed on the transfer material;

a third pre-transfer density detecting sensor for detecting a density of the toner image formed on the image holding component of the third image forming unit; and a fourth pre-transfer density detecting sensor for detecting a density of the toner image formed on the image holding component of the fourth image forming unit.

23. An image forming apparatus comprising:

a first image forming unit for forming a first electrostatic latent image on a first image holding component and for transferring a toner image obtained by developing the first electrostatic latent image using a first color toner onto a transfer material which is moving;

a second image forming unit, being located at a downstream side of the first image forming unit in a moving direction of the transfer material, for forming a second electrostatic latent image on a second image holding component and for transferring a toner image obtained by developing the second electrostatic latent image using a second color toner onto the transfer material;

a third image forming unit, being located at a downstream side of the second image forming unit in the moving direction of the transfer material, for forming a third electrostatic latent image on a third image holding component and for transferring a toner image obtained by developing the third electrostatic latent image using a third color toner onto the transfer material;

a fourth image forming unit, being located at a downstream side of the third image forming unit in the moving direction of the transfer material, for forming a fourth electrostatic latent image on a fourth image holding component and for transferring a toner image obtained by developing the fourth electrostatic latent image using a fourth color toner onto the transfer material;

a first sensor, being located between the first image forming unit and the second image forming unit, for detecting a toner density of the toner image formed onto the transfer material;

a second sensor, being located between the second image forming unit and the third image forming unit, for detecting a toner density of the toner image formed on the transfer material;

a third sensor, being located between the third image forming unit and the fourth image forming unit, for detecting a toner density of the toner image formed onto the transfer material;

a fourth sensor, being located at a downstream side of a transfer position of the fourth image forming unit in the moving direction of the transfer material, for detecting a toner density of the toner image formed on the transfer material; and a controller for having the first to fourth image forming units respectively form pattern images on the transfer material, with the pattern images being used for determining a plurality of image forming conditions, and wherein the pattern images include four single-color pattern images, with the single-color being one of first to fourth colors, and include six two-color pattern images, with the two-color being formed by a combination of two colors out of the first to fourth colors.

24. An image forming apparatus comprising:

a first image forming unit for forming a first electrostatic latent image on a first image holding component and for transferring a toner image obtained by developing the first electrostatic latent image onto a transfer material which is moving;

a second image forming unit, being located at a downstream side of the first image forming unit in a moving direction of the transfer material, for forming a second electrostatic latent image on a second image holding component and for transferring a toner image obtained by developing the second electrostatic latent image onto the transfer material;

a reattraction detecting unit for detecting an amount of toner moving from a pattern image to the image holding component of the second image forming unit when the pattern image passes by a transfer position of the second image forming unit, with the pattern image being formed on the transfer material by the first image forming unit and used for determining an image forming condition; and a controlling unit for controlling the image forming condition for an image formation performed by the second image forming unit, in accordance with a detected amount of toner.

* * * * *